US010366669B2

(12) United States Patent
Bae et al.

(10) Patent No.: US 10,366,669 B2
(45) Date of Patent: Jul. 30, 2019

(54) ELECTRONIC DEVICE AND METHOD FOR DRIVING DISPLAY THEREOF

(71) Applicant: SAMSUNG ELECTRONICS CO., LTD., Suwon-si, Gyeonggi-do (KR)

(72) Inventors: Jongkon Bae, Seoul (KR); Donghui Kim, Hwaseong-si (KR); Hongkook Lee, Seoul (KR); Hyunsuk Jung, Hwaseong-si (KR); Dongkyoon Han, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/454,270

(22) Filed: Mar. 9, 2017

(65) Prior Publication Data

US 2017/0263206 A1 Sep. 14, 2017

(30) Foreign Application Priority Data

Mar. 9, 2016 (KR) ..... 10-2016-0028106

(51) Int. Cl.
*G09G 5/00* (2006.01)
*G09G 5/395* (2006.01)
(Continued)

(52) U.S. Cl.
CPC ..... *G09G 5/001* (2013.01); *G09G 3/2092* (2013.01); *G09G 5/395* (2013.01); *G09G 5/003* (2013.01);
(Continued)

(58) Field of Classification Search
CPC ..... G09G 5/001; G09G 5/395; G09G 2320/0613; G09G 2320/103; G09G 2340/02; G09G 2360/08
(Continued)

(56) References Cited

U.S. PATENT DOCUMENTS 7,876,313 B2 * 1/2011 Selwan ..... G09G 3/3611 345/204
9,424,805 B2 8/2016 Lee et al.
(Continued)

FOREIGN PATENT DOCUMENTS

KR 10-0989314 10/2010
KR 10-2012-0036062 4/2012
(Continued)

OTHER PUBLICATIONS

Search Report dated Jun. 12, 2017 in counterpart International Patent Application No. PCT/KR2017/002553.
(Continued)

*Primary Examiner* — Jacinta M Crawford
(74) *Attorney, Agent, or Firm* — Nixon & Vanderhye P.C.

(57) ABSTRACT

An electronic device is provided, which includes a display, a processor configured to generate a plurality of frame images including a first frame image and a second frame image to be provided to the display, and a display driving circuit including an image processor and a memory, and configured to drive the display using the first frame image and the second frame image that are provided from the processor. The display driving circuit is configured to compare the second image frame to the first image frame, to display, through the display, a third image frame obtained through the image processor, the image processor processing the first image frame or the second image frame using an image processing scheme if the second image frame satisfies a first condition, to store the third image frame in the memory and to display the stored third image frame through the display if the second image frame satisfies a second condition.

17 Claims, 13 Drawing Sheets

(51) Int. Cl.
*G09G 3/20* (2006.01)
*G09G 5/393* (2006.01)

(52) U.S. Cl.
CPC ..... *G09G 5/393* (2013.01); *G09G 2320/0613* (2013.01); *G09G 2320/0686* (2013.01); *G09G 2320/103* (2013.01); *G09G 2330/021* (2013.01); *G09G 2340/02* (2013.01); *G09G 2340/0435* (2013.01); *G09G 2360/08* (2013.01); *G09G 2360/18* (2013.01)

(58) Field of Classification Search
USPC ..... 345/501, 530, 545
See application file for complete search history.

(56) References Cited

U.S. PATENT DOCUMENTS

| | | | | |
|---|---|---|---|---|
| 9,478,191 | B2 | 10/2016 | Lee et al. | |
| 2005/0225681 | A1 | 10/2005 | Sohn | |
| 2012/0120083 | A1* | 5/2012 | Kong | G09G 5/003 345/545 |
| 2012/0249563 | A1* | 10/2012 | Wyatt | G09G 5/36 345/522 |
| 2013/0113997 | A1 | 5/2013 | Lee et al. | |
| 2013/0201124 | A1 | 8/2013 | Choi et al. | |
| 2013/0235014 | A1 | 9/2013 | Lee et al. | |
| 2014/0118377 | A1 | 5/2014 | Bae et al. | |
| 2014/0160106 | A1* | 6/2014 | Choi | G09G 5/363 345/212 |
| 2015/0103081 | A1* | 4/2015 | Bae | G06T 1/20 345/501 |
| 2015/0130824 | A1* | 5/2015 | Lee | G06T 1/60 345/534 |
| 2016/0035297 | A1 | 2/2016 | Oh et al. | |

FOREIGN PATENT DOCUMENTS

| | | |
|---|---|---|
| KR | 10-2013-0051312 | 5/2013 |
| KR | 10-2014-0110242 | 9/2014 |
| KR | 10-2015-0069994 | 6/2015 |
| KR | 10-2015-0092435 | 8/2015 |

OTHER PUBLICATIONS

European Extended Search Report for EP Application No. 17763587.7 dated Nov. 30, 2018.

* cited by examiner

ELECTRONIC DEVICE AND METHOD FOR DRIVING DISPLAY THEREOF

CROSS-REFERENCE TO RELATED APPLICATION

This application is based on and claims priority under 35 U.S.C. § 119 to a Korean patent application filed on Mar. 9, 2016 in the Korean Intellectual Property Office and assigned Serial number 10-2016-0028106, the disclosure of which is incorporated by reference herein in its entirety.

BACKGROUND

Field

The present disclosure relates generally to an electronic device that processes image frames and a method for driving a display of the electronic device.

Description of Related Art

Recently, various electronic devices, such as a smart phone, a tablet Personnel Computer (PC), a Portable Multimedia Player (PMP), a Personal Digital Assistant (PDA), a laptop Personal Computer (PC), and a wearable device, can provide not only phone functions but also various functions (e.g., Social Network Service (SNS), Internet, multimedia, photographing and moving image capturing and execution, and documentation).

With the extensive spread of electronic devices that include display modules having HDTV-class ultrahigh resolutions, displays of portable electronic devices have been developed to have resolutions of WVGA or full-HD classes.

However, in providing an image having the ultrahigh resolution, the amount of video data that is processed by the electronic device and the amount of power that is consumed during data processing may be abruptly increased.

SUMMARY

An example aspect of the present disclosure provides an electronic device that can control an image data processing path and a method for driving a display of the electronic device.

In accordance with an example aspect of the present disclosure, an electronic device may include a display; a processor configured to generate a plurality of frame images including a first frame image and a second frame image to be provided to the display; and a display driving circuit including an image processor and a memory, and configured to drive the display using the first frame image and the second frame image that are provided from the processor. The display driving circuit may be configured to confirm the second image frame in relation to the first image frame, to display, through the display, a third image frame that is obtained through the image processor that processes the first image frame or the second image frame using an image processing scheme if the second image frame satisfies a first condition, and to store the third image frame in the memory and to display the stored third image frame through the display if the second image frame satisfies a second condition.

In accordance with another example aspect of the present disclosure, a method for driving a display of an electronic device, including a display, a processor configured to generate a plurality of frame images including a first frame image and a second frame image to be provided to the display, and a display driving circuit including an image processor and a memory, includes confirming, by the display driving circuit, the second image frame in relation to the first image frame; displaying, through the display, a third image frame that is obtained through the image processor that processes the first image frame or the second image frame using an image processing scheme if the second image frame satisfies a first condition; storing the third image frame in the memory; and displaying the stored third image frame through the display if the second image frame satisfies a second condition.

According to the electronic device and the method for driving the display thereof according to various example embodiments of the present disclosure, it becomes possible to control the image data processing path based on the state or mode of the electronic device or the type of the image data.

According to the electronic device and the method for driving the display thereof according to various example embodiments of the present disclosure, it becomes possible to prevent and/or reduce the processing operation of unnecessary image data, to reduce the throughput of the image data, and to reduce the power consumption that is caused by the processing of the unnecessary image data.

According to the electronic device and the method for driving the display thereof according to various example embodiments of the present disclosure, it becomes possible to control the operations of elements that are included in the display driving circuit based on the state or mode of the electronic device or the type of the image data.

According to the electronic device and the method for driving the display thereof according to various example embodiments of the present disclosure, it becomes possible to improve the quality of the image that is output to the display according to circumstances and/or to reduce the consumed power.

BRIEF DESCRIPTION OF THE DRAWINGS

The above aspects, features and attendant advantages of the present disclosure will be more apparent and readily appreciated from the following detailed description, taken in conjunction with the accompanying drawings, in which like reference numerals refer to like elements, and wherein.

DETAILED DESCRIPTION

Figure 1:
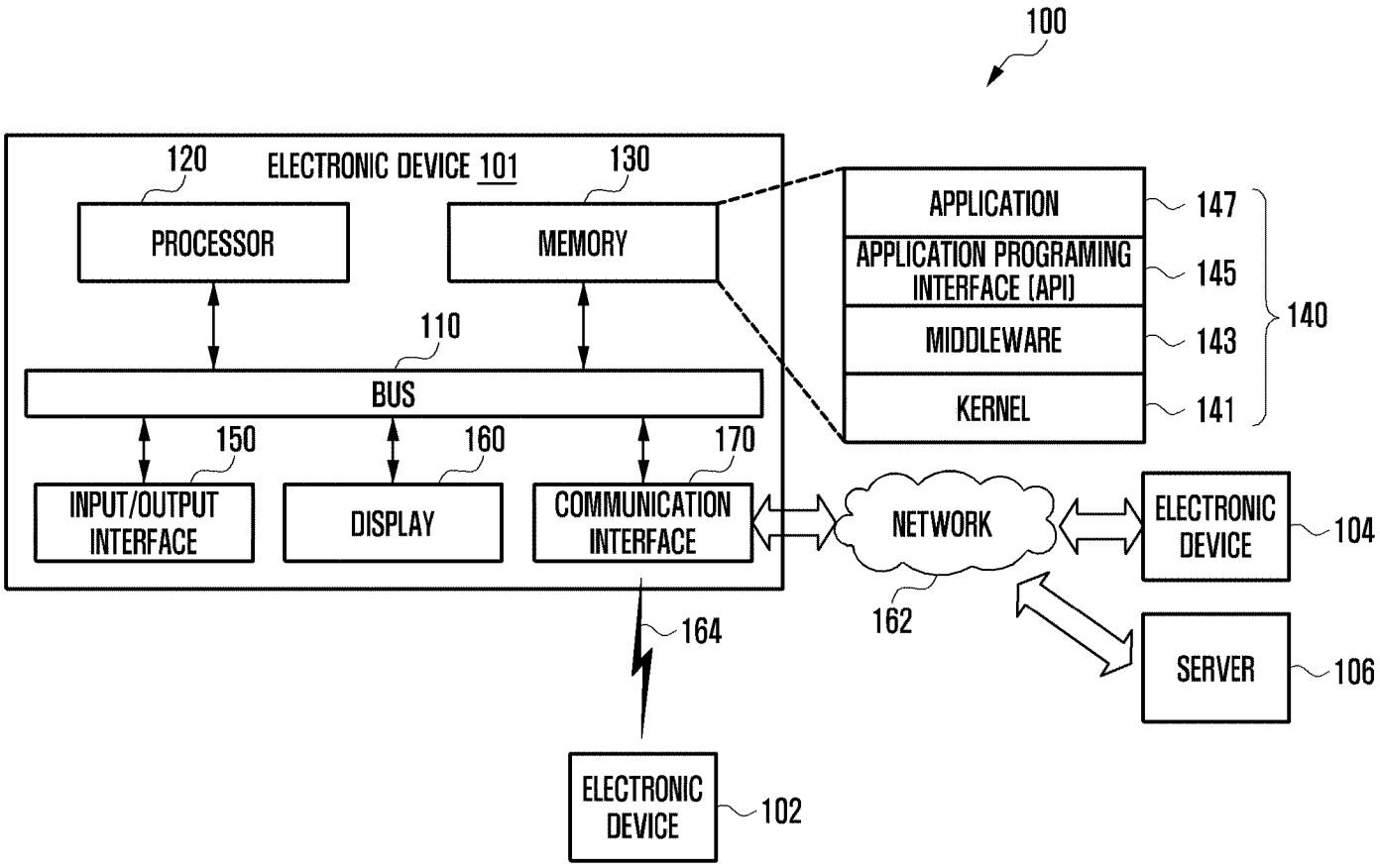
FIG. 1 is a diagram illustrating an example electronic device in a network environment according to various example embodiments of the present disclosure.

Hereinafter, various example embodiments of the present disclosure will be described in greater detail with reference to the accompanying drawings. While the present disclosure may be embodied in many different forms, specific embodiments of the present disclosure are illustrated in drawings and are described herein in detail, with the understanding that the present disclosure is to be considered as an exemplification of the principles of the disclosure and is not intended to limit the disclosure to the specific embodiments illustrated. The same reference numbers are used throughout the drawings to refer to the same or like parts.

An expression "comprising" or "may comprise" used in the present disclosure indicates presence of a corresponding function, operation, or element and does not limit the at least one function, operation, or element. Further, in the present disclosure, a term "comprise" or "have" indicates presence of a characteristic, numeral, step, operation, element, component, or combination thereof described in the disclosure and does not exclude presence or addition of at least one other characteristic, numeral, step, operation, element, component, or combination thereof.

In the present disclosure, an expression "or" includes any combination or the entire combination of together listed words. For example, "A or B" may include A, B, or A and B.

An expression of a first and a second in the present disclosure may represent various elements of the present disclosure, but does not limit corresponding elements. For example, the expression does not limit order and/or importance of corresponding elements. The expression may be used for distinguishing one element from another element. For example, both a first user device and a second user device are user devices and may represent the same or different user devices. For example, a first element may be referred to as a second element without deviating from the scope of the present disclosure, and similarly, a second element may be referred to as a first element.

When it is described that an element is "coupled" to another element, the element may be "directly coupled" to the other element or "electrically coupled" to the other element through a third element. However, when it is described that an element is "directly coupled" to another element, no element may exist between the element and the other element.

Terms used in the present disclosure are not intended to limit the present disclosure but to illustrate various example embodiments. In the present disclosure and the appended claims, a singular form includes a plurality of forms unless it is explicitly differently represented.

Unless otherwise defined, terms including a technical term and a scientific term used here have the same meaning as a meaning that may be generally understood by a person of common skill in the art. It should be understood that generally using terms defined in a dictionary have a meaning corresponding to that of a context of related technology and are not to be construed as having an ideal or excessively formal meaning unless explicitly defined.

In this disclosure, an electronic device may be a device that involves a communication function. For example, an electronic device may be a smart phone, a tablet PC (Personal Computer), a mobile phone, a video phone, an e-book reader, a desktop PC, a laptop PC, a netbook computer, a PDA (Personal Digital Assistant), a PMP (Portable Multimedia Player), an MP3 player, a portable medical device, a digital camera, or a wearable device (e.g., an HMD (Head-Mounted Device) such as electronic glasses, electronic clothes, an electronic bracelet, an electronic necklace, an electronic appcessory, or a smart watch), or the like, but is not limited thereto.

According to some example embodiments, an electronic device may be a smart home appliance that involves a communication function. For example, an electronic device may be a TV, a DVD (Digital Video Disk) player, audio equipment, a refrigerator, an air conditioner, a vacuum cleaner, an oven, a microwave, a washing machine, an air cleaner, a set-top box, a TV box (e.g., Samsung HomeSync™, Apple TV™, Google TV™, etc.), a game console, an electronic dictionary, an electronic key, a camcorder, or an electronic picture frame, or the like, but is not limited thereto.

According to some example embodiments, an electronic device may be a medical device (e.g., MRA (Magnetic Resonance Angiography), MRI (Magnetic Resonance Imaging), CT (Computed Tomography), ultrasonography, etc.), a navigation device, a GPS (Global Positioning System) receiver, an EDR (Event Data Recorder), an FDR (Flight Data Recorder), a car infotainment device, electronic equipment for ship (e.g., a marine navigation system, a gyrocompass, etc.), avionics, security equipment, or an industrial or home robot, or the like, but is not limited thereto.

According to some embodiments, an electronic device may be furniture or part of a building or construction having a communication function, an electronic board, an electronic signature receiving device, a projector, or various measuring instruments (e.g., a water meter, an electric meter, a gas meter, a wave meter, etc.), or the like, but is not limited thereto. An electronic device disclosed herein may be one of the above-mentioned devices or any combination thereof. As well understood by those skilled in the art, the above-mentioned electronic devices are examples only and not to be considered as a limitation of this disclosure.

FIG. 1 is a block diagram illustrating an example electronic apparatus in a network environment 100 according to an example embodiment of the present disclosure.

Referring to FIG. 1, the electronic apparatus 101 may include a bus 110, a processor (e.g., including processing circuitry) 120, a memory 130, an input/output interface (e.g., including input/output circuitry) 150, a display 160, and a communication interface (e.g., including communication circuitry) 170.

The bus 110 may be a circuit for interconnecting elements described above and for allowing a communication, e.g. by transferring a control message, between the elements described above.

The processor 120 may include various processing circuitry and can receive commands from the above-mentioned other elements, e.g. the memory 130, the input/output interface 150, the display 160, and the communication interface 170, through, for example, the bus 110, can decipher the received commands, and perform operations and/or data processing according to the deciphered commands.

The memory 130 can store commands received from the processor 120 and/or other elements, e.g. the input/output interface 150, the display 160, and the communication interface 170, and/or commands and/or data generated by the processor 120 and/or other elements. The memory 130 may include softwares and/or programs 140, such as a kernel 141, middleware 143, an Application Programming Interface (API) 145, and an application 147. Each of the programming modules described above may be configured by software, firmware, hardware, and/or combinations of two or more thereof.

The kernel 141 can control and/or manage system resources, e.g. the bus 110, the processor 120 or the memory 130, used for execution of operations and/or functions implemented in other programming modules, such as the middleware 143, the API 145, and/or the application 147. Further, the kernel 141 can provide an interface through which the middleware 143, the API 145, and/or the application 147 can access and then control and/or manage an individual element of the electronic apparatus 101.

The middleware 143 can perform a relay function which allows the API 145 and/or the application 147 to communicate with and exchange data with the kernel 141. Further, in relation to operation requests received from at least one of an application 147, the middleware 143 can perform load balancing in relation to the operation requests by, for example, giving a priority in using a system resource, e.g. the bus 110, the processor 120, and/or the memory 130, of the electronic apparatus 101 to at least one application from among the at least one of the application 147.

The API 145 is an interface through which the application 147 can control a function provided by the kernel 141 and/or the middleware 143, and may include, for example, at least one interface or function for file control, window control, image processing, and/or character control.

The input/output interface 150 may include various input/output circuitry and can receive, for example, a command and/or data from a user, and transfer the received command and/or data to the processor 120 and/or the memory 130 through the bus 110. The display 160 can display an image, a video, and/or data to a user.

The communication interface 170 may include various communication circuitry and can establish a communication between the electronic apparatus 101 and other electronic devices 102 and 104 and/or a server 106. The communication interface 170 can support short range communication protocols 164, e.g. a Wireless Fidelity (WiFi) protocol, a BlueTooth (BT) protocol, and a Near Field Communication (NFC) protocol, communication networks 164, e.g. Internet, Local Area Network (LAN), Wire Area Network (WAN), a telecommunication network, a cellular network, and a satellite network, or a Plain Old Telephone Service (POTS), or any other similar and/or suitable communication networks, such as network 162, or the like. Each of the electronic devices 102 and 104 may be a same type and/or different types of electronic apparatus.

Figure 2:
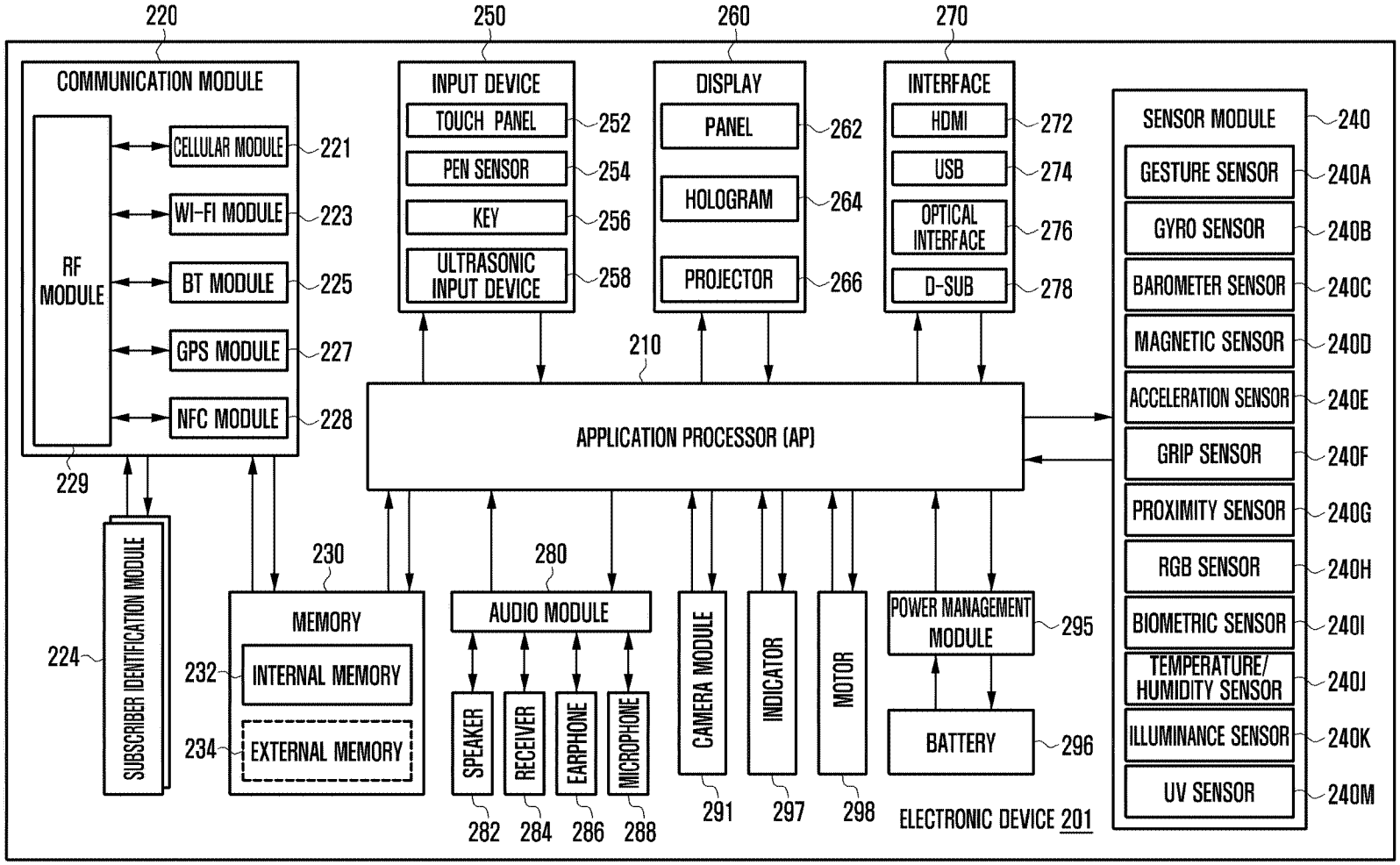
FIG. 2 is a block diagram illustrating an example electronic device according to various example embodiments of the present disclosure.

FIG. 2 is a block diagram illustrating an example electronic device 201 in accordance with an example embodiment of the present disclosure. The electronic device 201 may form, for example, the whole or part of the electronic device 201 illustrated in FIG. 1.

Referring to FIG. 2, the electronic device 201 may include at least one application processor (AP) (e.g., including processing circuitry) 210, a communication module (e.g., including communication circuitry) 220, a subscriber identification module (SIM) card 224, a memory 230, a sensor module 240, an input device (e.g., including input circuitry) 250, a display 260, an interface (e.g., including interface circuitry) 270, an audio module 280, a camera module 291, a power management module 295, a battery 296, an indicator 297, and a motor 298.

The AP 210 may include various processing circuitry and drive an operating system or applications, control a plurality of hardware or software components connected thereto, and also perform processing and operation for various data including multimedia data. The AP 210 may be formed of system-on-chip (SoC), for example. According to an embodiment, the AP 210 may further include a graphic processing unit (GPU) (not shown).

The communication module 220 (e.g., the communication interface 170) may include various communication circuitry and perform a data communication with any other electronic device (e.g., the electronic device 104 or the server 106) connected to the electronic device 200 (e.g., the electronic device 101) through the network. According to an example embodiment, the communication module 220 may include various communication circuitry therein, such as, for example, and without limitation, a cellular module 221, a WiFi module 223, a BT module 225, a GPS module 227, an NFC module 228, and an RF (Radio Frequency) module 229.

The cellular module 221 may offer a voice call, a video call, a message service, an internet service, or the like through a communication network (e.g., LTE, LTE-A, CDMA, WCDMA, UMTS, WiBro, or GSM, etc.). Additionally, the cellular module 221 may perform identification and authentication of the electronic device in the communication network, using the SIM card 224. According to an example embodiment, the cellular module 221 may perform at least part of functions the AP 210 can provide. For example, the cellular module 221 may perform at least part of a multimedia control function.

According to an example embodiment, the cellular module 221 may include a communication processor (CP). Additionally, the cellular module 221 may be formed of SoC, for example. Although some elements such as the cellular module 221 (e.g., the CP), the memory 230, or the power management module 295 are shown as separate elements being different from the AP 210 in FIG. 3, the AP 210 may be formed to have at least part (e.g., the cellular module 321) of the above elements in an embodiment.

According to an example embodiment, the AP 210 or the cellular module 221 (e.g., the CP) may load commands or data, received from a nonvolatile memory connected thereto or from at least one of the other elements, into a volatile memory to process them. Additionally, the AP 210 or the cellular module 221 may store data, received from or created at one or more of the other elements, in the nonvolatile memory.

Each of the WiFi module 223, the BT module 225, the GPS module 227 and the NFC module 228 may include a processor for processing data transmitted or received therethrough. Although FIG. 2 shows the cellular module 221, the WiFi module 223, the BT module 225, the GPS module 227 and the NFC module 228 as different blocks, at least part of them may be contained in a single IC (Integrated Circuit) chip or a single IC package in an embodiment. For example, at least part (e.g., the CP corresponding to the cellular module 221 and a WiFi processor corresponding to the WiFi module 223) of respective processors corresponding to the cellular module 221, the WiFi module 223, the BT module 225, the GPS module 227 and the NFC module 228 may be formed as a single SoC.

The RF module 229 may transmit and receive data, e.g., RF signals or any other electric signals. Although not shown, the RF module 229 may include a transceiver, a PAM (Power Amp Module), a frequency filter, an LNA (Low Noise Amplifier), or the like. Also, the RF module 229 may include any component, e.g., a wire or a conductor, for transmission of electromagnetic waves in a free air space. Although FIG. 2 illustrates that the cellular module 221, the WiFi module 223, the BT module 225, the GPS module 227 and the NFC module 228 share the RF module 229, at least one of them may perform transmission and reception of RF signals through a separate RF module in an embodiment.

The SIM card 224 may be a specific card formed of SIM and may be inserted into a slot formed at a certain place of the electronic device 201. The SIM card 224 may contain therein an ICCID (Integrated Circuit Card IDentifier) or an IMSI (International Mobile Subscriber Identity).

The memory 230 (e.g., the memory 130) may include an internal memory 232 and/or an external memory 234. The internal memory 232 may include, for example, at least one of a volatile memory (e.g., DRAM (Dynamic RAM), SRAM (Static RAM), SDRAM (Synchronous DRAM), etc.) or a nonvolatile memory (e.g., OTPROM (One Time Programmable ROM), PROM (Programmable ROM), EPROM (Erasable and Programmable ROM), EEPROM (Electrically Erasable and Programmable ROM), mask ROM, flash ROM, NAND flash memory, NOR flash memory, etc.).

According to an example embodiment, the internal memory 232 may have the form of an SSD (Solid State Drive). The external memory 234 may include a flash drive, e.g., CF (Compact Flash), SD (Secure Digital), Micro-SD (Micro Secure Digital), Mini-SD (Mini Secure Digital), xD (eXtreme Digital), memory stick, or the like. The external memory 334 may be functionally connected to the electronic device 201 through various interfaces. According to an example embodiment, the electronic device 301 may further include a storage device or medium such as a hard drive.

The sensor module 240 may measure physical quantity or sense an operating status of the electronic device 201, and then convert measured or sensed information into electrical signals. The sensor module 240 may include, for example, at least one of a gesture sensor 240A, a gyro sensor 240B, an atmospheric (e.g., barometer) sensor 240C, a magnetic sensor 240D, an acceleration sensor 240E, a grip sensor 240F, a proximity sensor 240G, a color sensor 240H (e.g., RGB (Red, Green, Blue) sensor), a biometric sensor 240I, a temperature-humidity sensor 240J, an illuminance (e.g., light) sensor 240K, and a UV (ultraviolet) sensor 240M. Additionally or alternatively, the sensor module 240 may include, e.g., an E-nose sensor (not shown), an EMG (electromyography) sensor (not shown), an EEG (electroencephalogram) sensor (not shown), an ECG (electrocardiogram) sensor (not shown), an IR (infrared) sensor (not shown), an iris scan sensor (not shown), or a finger scan sensor (not shown). Also, the sensor module 240 may include a control circuit for controlling one or more sensors equipped therein.

The input device 250 may include various input circuitry, such as, for example, and without limitation, a touch panel 252, a digital pen sensor 254, a key 256, or an ultrasonic input unit 258. The touch panel 252 may recognize a touch input in a manner of capacitive type, resistive type, infrared type, or ultrasonic type. Also, the touch panel 252 may further include a control circuit. In case of a capacitive type, a physical contact or proximity may be recognized. The touch panel 252 may further include a tactile layer. In this case, the touch panel 252 may offer a tactile feedback to a user.

The digital pen sensor 254 may be formed in the same or similar manner as receiving a touch input or by using a separate recognition sheet. The key 256 may include, for example, a physical button, an optical key, or a keypad. The ultrasonic input unit 258 is a specific device capable of identifying data by sensing sound waves with a microphone 288 in the electronic device 201 through an input tool that generates ultrasonic signals, thus allowing wireless recognition. According to an example embodiment, the electronic device 201 may receive a user input from any external device (e.g., a computer or a server) connected thereto through the communication module 220.

The display 260 (e.g., the display 250) may include a panel 262, a hologram 264, or a projector 266. The panel 262 may be, for example, LCD (Liquid Crystal Display), AM-OLED (Active Matrix Organic Light Emitting Diode), or the like. The panel 262 may have a flexible, transparent or wearable form. The panel 262 may be formed of a single module with the touch panel 252. The hologram 264 may show a stereoscopic image in the air using interference of light. The projector 266 may project an image onto a screen, which may be located at the inside or outside of the electronic device 201. According to an embodiment, the display 260 may further include a control circuit for controlling the panel 262, the hologram 264, and the projector 266.

According to an example embodiment, the display 260 may include a panel 262 and a display driving circuit (e.g., display driving IC) (not illustrated). According to an embodiment, the display driving circuit may include an interface, a graphic memory, an image processor, a source driver, a gate driver, and a controller.

The interface 270 may include various interface circuitry, such as, for example, and without limitation, an HDMI (High-Definition Multimedia Interface) 272, a USB (Universal Serial Bus) 274, an optical interface 276, or a D-sub (D-subminiature) 278. The interface 270 may be contained, for example, in the communication interface 160 illustrated in FIG. 1. Additionally, or alternatively, the interface 270 may include, for example, an MHL (Mobile High-definition Link) interface, an SD (Secure Digital) card/MMC (Multi-Media Card) interface, or an IrDA (Infrared Data Association) interface.

The audio module 280 may perform a conversion between sounds and electric signals. The audio module 280 may process sound information input or output through a speaker 282, a receiver 284, an earphone 286, or a microphone 288.

The camera module 291 is a device capable of obtaining still images and moving images. According to an example embodiment, the camera module 291 may include at least one image sensor (e.g., a front sensor or a rear sensor), a lens (not shown), an ISP (Image Signal Processor, not shown), or a flash (e.g., LED or xenon lamp, not shown).

The power management module 295 may manage electric power of the electronic device 201. Although not shown, the power management module 295 may include, for example, a PMIC (Power Management Integrated Circuit), a charger IC, or a battery or fuel gauge.

The PMIC may be formed, for example, of an IC chip or SoC. Charging may be performed in a wired or wireless manner. The charger IC may charge a battery 296 and prevent overvoltage or overcurrent from a charger. According to an example embodiment, the charger IC may have a charger IC used for at least one of wired and wireless charging types. A wireless charging type may include, for example, a magnetic resonance type, a magnetic induction type, or an electromagnetic type. Any additional circuit for a wireless charging may be further used such as a coil loop, a resonance circuit, or a rectifier.

The battery gauge may measure the residual amount of the battery 296 and a voltage, current or temperature in a charging process. The battery 296 may store or create electric power therein and supply electric power to the electronic device 201. The battery 296 may be, for example, a rechargeable battery or a solar battery.

The indicator 297 may show thereon a current status (e.g., a booting status, a message status, or a recharging status) of the electronic device 201 or of its part (e.g., the AP 210). The motor 298 may convert an electric signal into a mechanical vibration. Although not shown, the electronic device 301 may include a specific processor (e.g., GPU) for supporting a mobile TV. This processor may process media data that comply with standards of DMB (Digital Multimedia Broadcasting), DVB (Digital Video Broadcasting), or media flow.

Each of the above-discussed elements of the electronic device disclosed herein may be formed of one or more components, and its name may be varied based on the type of the electronic device. The electronic device disclosed herein may be formed of at least one of the above-discussed elements without some elements or with additional other elements. Some of the elements may be integrated into a single entity that still performs the same functions as those of such elements before integrated.

The term "module" used in this disclosure may refer, for example, to a certain unit that includes one of hardware, software and firmware or any combination thereof. The module may be interchangeably used with unit, logic, logical block, component, or circuit, for example. The module may be the minimum unit, or part thereof, which performs one or more particular functions. The module may be formed mechanically or electronically. For example, the module disclosed herein may include, without limitation, at least one of a dedicated processor, a CPU, an ASIC (Application-Specific Integrated Circuit) chip, FPGAs (Field-Programmable Gate Arrays), and programmable-logic device, which have been known or are to be developed.

Figure 3:
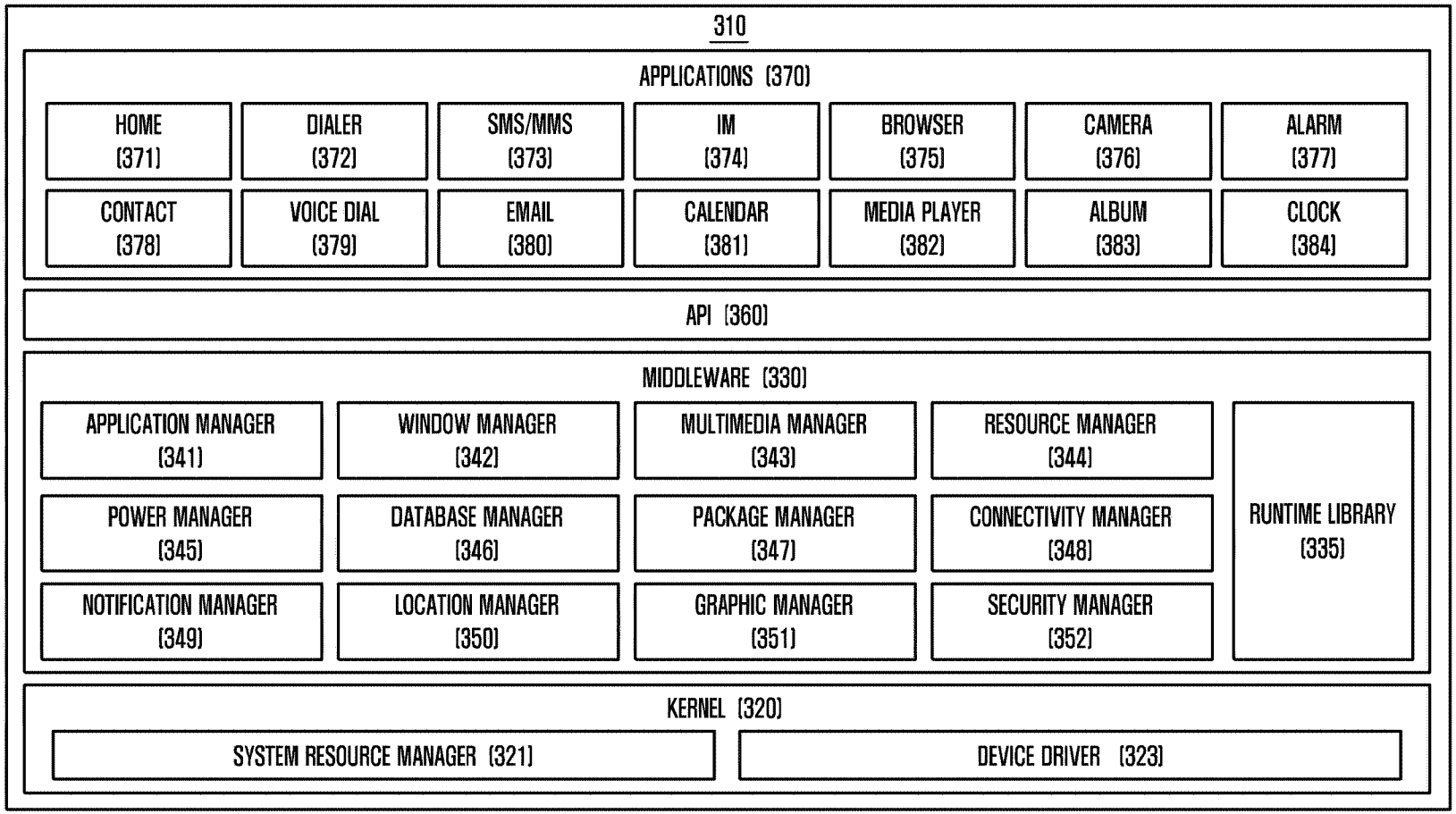
FIG. 3 is a block diagram illustrating an example program module according to various example embodiments of the present disclosure.

FIG. 3 is a block diagram illustrating an example configuration of an example programming module 310 according to an example embodiment of the present disclosure.

The programming module 310 may be included (or stored) in the electronic device 301 (e.g., the memory 330) illustrated in FIG. 1 or may be included (or stored) in the electronic device 201 (e.g., the memory 230) illustrated in FIG. 2. At least a part of the programming module 310 may be implemented in software, firmware, hardware, or a combination of two or more thereof. The programming module 310 may be implemented in hardware, and may include an OS controlling resources related to an electronic device (e.g., the electronic device 101 or 201) and/or various applications (e.g., an application 370) executed in the OS. For example, the OS may be Android, iOS, Windows, Symbian, Tizen, Bada, and the like.

Referring to FIG. 3, the programming module 310 may include a kernel 320, a middleware 330, an API 360, and/or the application 370.

The kernel 320 (e.g., the kernel 141) may include a system resource manager 321 and/or a device driver 323. The system resource manager 321 may include, for example, a process manager (not illustrated), a memory manager (not illustrated), and a file system manager (not illustrated). The system resource manager 321 may perform the control, allocation, recovery, and/or the like of system resources. The device driver 323 may include, for example, a display driver (not illustrated), a camera driver (not illustrated), a Bluetooth driver (not illustrated), a shared memory driver (not illustrated), a USB driver (not illustrated), a keypad driver (not illustrated), a Wi-Fi driver (not illustrated), and/or an audio driver (not illustrated). Also, according to an embodiment of the present disclosure, the device driver 323 may include an Inter-Process Communication (IPC) driver (not illustrated).

The middleware 330 may include multiple modules previously implemented to provide a function used in common by the applications 370. Also, the middleware 330 may provide a function to the applications 370 through the API 360 to enable the applications 370 to efficiently use limited system resources within the electronic device. For example, as illustrated in FIG. 3, the middleware 330 (e.g., the middleware 143) may include at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, a security manager 352, and any other suitable and/or similar manager.

The runtime library 335 may include, for example, a library module used by a complier, in order to add a new function by using a programming language during the execution of the application 370. According to an example embodiment of the present disclosure, the runtime library 435 may perform functions which are related to input and output, the management of a memory, an arithmetic function, and/or the like.

The application manager 341 may manage, for example, a life cycle of at least one of the applications 370. The window manager 342 may manage GUI resources used on the screen. The multimedia manager 343 may detect a format used to reproduce various media files and may encode or decode a media file through a codec appropriate for the relevant format. The resource manager 344 may manage resources, such as a source code, a memory, a storage space, and/or the like of at least one of the applications 370.

The power manager 345 may operate together with a Basic Input/Output System (BIOS), may manage a battery or power, and may provide power information and the like used for an operation. The database manager 346 may manage a database in such a manner as to enable the generation, search and/or change of the database to be used by at least one of the applications 370. The package manager 347 may manage the installation and/or update of an application distributed in the form of a package file.

The connectivity manager 348 may manage a wireless connectivity such as, for example, Wi-Fi and Bluetooth. The notification manager 349 may display or report, to the user, an event such as an arrival message, an appointment, a proximity alarm, and the like in such a manner as not to disturb the user. The location manager 350 may manage location information of the electronic device. The graphic manager 351 may manage a graphic effect, which is to be provided to the user, and/or a user interface related to the graphic effect. The security manager 352 may provide various security functions used for system security, user authentication, and the like. According to an embodiment of the present disclosure, when the electronic device (e.g., the electronic device 101) has a telephone function, the middleware 330 may further include a telephony manager (not illustrated) for managing a voice telephony call function and/or a video telephony call function of the electronic device.

The middleware 330 may generate and use a new middleware module through various functional combinations of the above-described internal element modules. The middleware 330 may provide modules specialized according to types of OSs in order to provide differentiated functions. Also, the middleware 330 may dynamically delete some of the existing elements, or may add new elements. Accordingly, the middleware 330 may omit some of the elements described in the various embodiments of the present disclosure, may further include other elements, or may replace the some of the elements with elements, each of which performs a similar function and has a different name.

The API 460 (e.g., the API 145) is a set of API programming functions, and may be provided with a different configuration according to an OS. In the case of Android or iOS, for example, one API set may be provided to each platform. In the case of Tizen, for example, two or more API sets may be provided to each platform.

The applications 370 (e.g., the applications 147) may include, for example, a preloaded application and/or a third party application. The applications 370 (e.g., the applications 147) may include, for example, a home application 371, a dialer application 372, a Short Message Service (SMS)/Multimedia Message Service (MMS) application 373, an Instant Message (IM) application 374, a browser application 375, a camera application 376, an alarm application 377, a contact application 378, a voice dial application 379, an electronic mail (e-mail) application 380, a calendar application 381, a media player application 382, an album application 383, a clock application 384, and any other suitable and/or similar application.

At least a part of the programming module 310 may be implemented by instructions stored in a non-transitory computer-readable storage medium. When the instructions are executed by one or more processors (e.g., the application processor 210), the one or more processors may perform functions corresponding to the instructions. The non-transitory computer-readable storage medium may be, for example, the memory 220. At least a part of the programming module 310 may be implemented (e.g., executed) by, for example, the one or more processors. At least a part of the programming module 310 may include, for example, a module, a program, a routine, a set of instructions, and/or a process for performing one or more functions.

Figure 4:
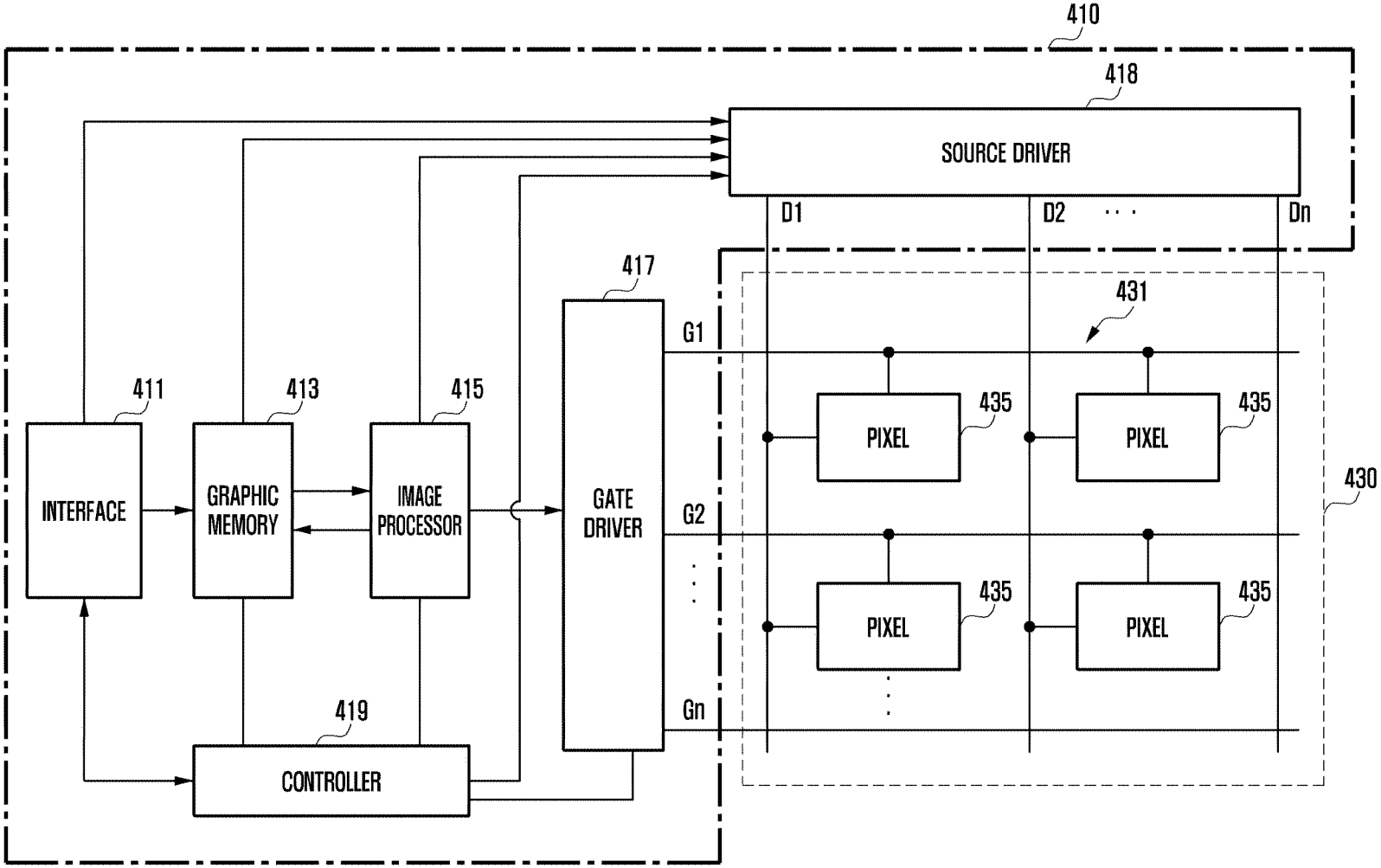
FIG. 4 is a block diagram illustrating an example display according to various example embodiments of the present disclosure.

FIG. 4 is a block diagram illustrating an example display according to various example embodiments of the present disclosure.

According to an example embodiment of the present disclosure, a display of an electronic device may include a panel 430 and a display driving circuit (display driving IC) 410. The panel 430 may include a pixel array 431 that is including a plurality of pixels. The pixel array 431 may configure a display region that is used as an image display screen. Each pixel 435 of the pixel array 431 may be independently driven by the display driving circuit 410. The panel 430 may include, for example, a Liquid Crystal Display (LCD), a Light Emitting Diode (LED) display, an Organic Light Emitting Diode (OLED) display, a Micro Electro Mechanical System (MEMS) display, or an electronic paper display, or the like, but is not limited thereto. According to an example embodiment, the panel 430 may include a touch panel and a display panel 430. For example, the panel 430 may be a touch screen.

The display driving circuit 410 may drive the panel 430 in accordance with input image data. The image data may be data that is stored in the electronic device or is received from an outside of the electronic device under the control of a processor (not illustrated). For example, the display driving circuit 410 may receive the image data in accordance with the control of the processor. Further, the display driving circuit 410 may drive the panel 430 in accordance with the input image data.

According to an example embodiment, the display driving circuit 410 may include an interface 411, a graphic memory 413, an image processor (IP) 415, a gate driver 417, a source driver 418, and a controller 419.

The interface 411 may receive the image data. The image data may include still image data and moving image data. The interface 411 may receive data and a clock signal from an outside (e.g., an internal element of the electronic device, such as a processor or a memory). For example, the clock signal may include a signal for synchronizing an image data processing procedure with the processor of the electronic device and a signal for synchronizing an image data processing cycle. According to an example embodiment, the interface 411 may transfer the image data that is received from the processor to the graphic memory 413. Under the control of the controller 419, the interface 411 may directly transmit the received image data to the image processor 415 or the source driver 418. According to an example embodiment, the interface 411 may receive, from the processor of the electronic device, a plurality of frame images including a first frame image and a second frame image that are generated by the processor to be provided to the display (e.g., panel 430).

The graphic memory 413 may store therein the image data that is received through the interface 411. For example, the graphic memory 413 may perform buffering of the received image data before transmitting the image data to another element (e.g., the image processor 415, source driver 418, or gate driver 417). According to an example embodiment, the graphic memory 413 may transmit the stored image data to the image processor 415. The graphic memory 413 may directly transmit the stored image data to the source driver 418 under the control of the controller 419.

The image processor 415 may improve the quality of the image data through processing of the image data. According to various example embodiments, the display driving circuit 410 may include one or more image processors 415. According to an example embodiment, the image processor 415 may transmit the processed image data to the source driver 418. The image processor 415 may transmit the processed image data to the graphic memory 413 under the control of the controller 419.

The gate driver 417 may scan and drive scan lines G1 to Gn that are connected to the pixels of the panel 430. The gate driver 417 may successively select the scan lines G1 to Gn one by one to apply scan drive signals thereto.

The source driver 418 may drive data lines D1 to Dn that are connected to the pixels of the panel 430. For example, the source driver 418 may drive the data lines D1 to Dn to correspond to the received image data.

The controller 419 may control the operation of the display driving circuit 410. According to an example embodiment, the controller 419 may control an image data processing path in the display driving circuit 410. For example, the controller 419 may control the image data processing path in accordance with the state of the electronic device (e.g., set mode of the electronic device or the like) or the type of the image data (e.g., whether the image data that is being processed is still image data or moving image data). According to an example embodiment, the controller 419 may include a timing controller for signal synchronization during processing of the image data. According to an example embodiment, the controller 419 may confirm the second image frame in relation to the first image frame. If the second image frame satisfies a first condition, the controller 419 may display a third image frame that is generated by the image processor 415 through a display (e.g., panel 430). For example, the first condition may be a condition that at least a part of the first image frame is not the same as at least a part of the second image frame or a condition that the first image frame is not the same as the second image frame. According to an example embodiment, if the second image frame does not satisfy the first condition, the controller 419 may store the third image frame that is generated by the image processor 415 in the graphic memory 413, and may display the stored third image frame on the display (e.g., panel 430). For example, if the first condition is not satisfied, the controller 419 may display the third image frame that has been processed and stored in the graphic memory 413 through the display (e.g., panel 430). According to an example embodiment, if the first condition is not satisfied, the controller 419 may determine that the second image frame satisfies a second condition. The second condition may correspond to a case where the electronic device is in a low-power mode (e.g., a case where the electronic device is in an Always On Display (AOD) state). According to an example embodiment, if the second condition is satisfied, the controller 419 may bypass the image processor and may display the first image frame or the second image frame through the display (e.g., panel 430). If the second condition is satisfied, the controller 419 may control the image processor not to provide the image frame to the panel 430.

Figure 5:
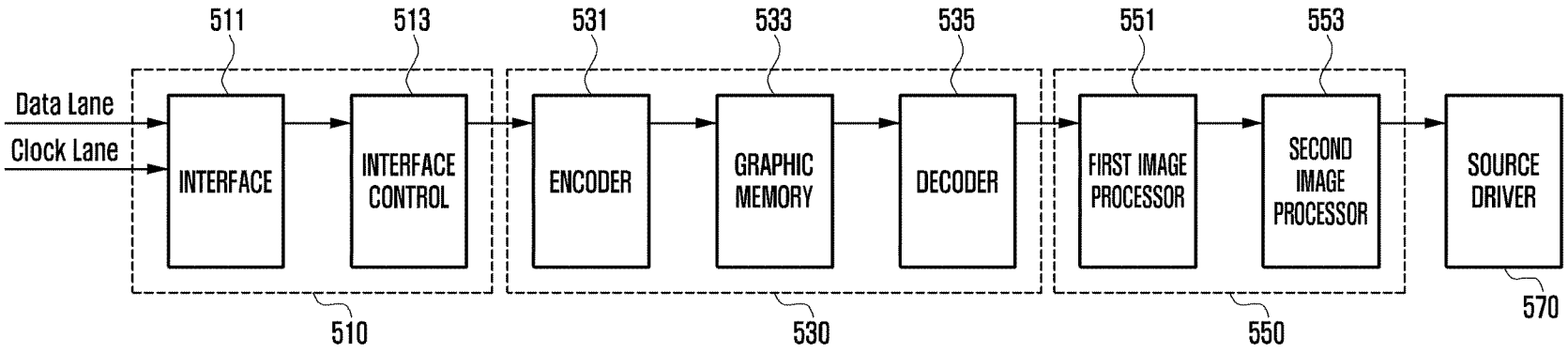
FIG. 5 is a diagram schematically illustrating example data flow during driving of a display according to various example embodiments of the present disclosure.

FIG. 5 is a diagram schematically illustrating example data flow during driving of a display according to various example embodiments of the present disclosure.

According to an example embodiment, the display driving circuit may include an interface unit (e.g., including interface circuitry) 510, a graphic memory unit (e.g., including graphic processing and storing circuitry) 530, an image processing unit (e.g., including image processing circuitry) 550, and a source driver 570.

The interface unit 510 may include various interface circuitry, including, for example, and without limitation, an interface 511 and an interface control 513. According to an example embodiment, the interface 511 may receive image data. For example, the interface 511 may receive still image data or moving image data. According to various example embodiments, the interface 511 may receive compressed image data or uncompressed image data. According to an example embodiment, the interface 511 may receive the still image data or the moving image data at a different speed. For example, in the case where the electronic device displays a moving image on the display, the display driving circuit requires to successively receive and process different pieces of image data in accordance with a frame rate. In the case where the electronic device displays the still image on the display, the display driving circuit may receive and process the image data at a lower speed in order to display the same image. According to an example embodiment, the interface 511 may receive the moving image data at a speed that corresponds to the frame rate for displaying the image on the panel. For example, the interface 511 may receive the still image data at a speed that is equal to or lower than the frame rate. For example, in the case where the interface 511 receives the image data that is transmitted from the electronic device, the interface 511 may receive the still image data at a speed that is relatively lower than the transmission speed of the moving image data.

According to an example embodiment, the interface 511 may receive a clock signal. For example, the interface 511 may receive a signal for synchronizing the operations of the processor of the electronic device and the display driving circuit. For example, the interface 511 may receive a signal for synchronizing the image data processing speed. According to an example embodiment, the interface 511 may transmit, under the control of a controller (not illustrated), a signal (e.g., Tearing Effect (TE) signal) for synchronizing the image data processing cycle in the display driving circuit with the operation of the processor of the electronic device to the processor.

According to an example embodiment, the interface control 513 may control the interface 511 to receive data or a signal under the control of the controller. The interface control 513 may operate, under the control of the controller, to transmit the data or signal that is received through the interface 511 to other elements of the display driving circuit. The interface 511 and the interface control 513 may be formed in a body as one module other than separate independent elements.

According to an example embodiment, the graphic memory unit 530 may include various graphic processing circuitry, such as, for example, and without limitation, an encoder 531 and a decoder 535, and storage circuitry, such as, a graphic memory 533.

The encoder 531 may compress image data that is stored in the graphic memory 533. For example, the encoder 531 may compress image data that is received through the interface 511 or image data that is processed by the image processing unit 550.

The graphic memory may store image data therein. For example, the graphic memory 533 may store therein the image data that is received through the interface unit 510 or the image data that is processed by the image processing unit 550. The graphic memory 533 may transmit the stored image data to the image processing unit 550 or the source driver 570.

The decoder 535 may decompress the compressed image data. According to an example embodiment, the display driving circuit may include one or more decoders 535 that correspond to a compression format of the image data. For example, the image data may be compressed in various formats based on the encoder 531 that compresses the image data. In this case, one or more decoders 535 that correspond to the compression format of the image data may be required. For example, in the case where the display driving circuit can receive the compressed image data and includes the encoder 531 for compressing the image data therein, the display driving circuit may include a first decoder for decompressing the received compressed image data and a second decoder 535 for decompress the image data that is compressed by the internal encoder 531.

The image processing unit 550 may include one or more image processors 551, 553, that improve the quality of the image data through processing of the image data. For example, the image processing unit 550 may remove noise of the image data through processing of the image data, optimize and/or improve a contrast ratio, increase a color sense, and improve the picture quality. For example, the image processing unit 550 may include at least one image processor that processes the image data in a different method in order to improve the quality of the image data. For example, the image processing unit 550 may include a mobile Digital Natural Image engine (mDNIe) module or a pentile module.

According to various example embodiments, at least one image processor (e.g., a first image processor 551 and a second image processor 553) may be configured as a different module to independently process the image data, or may be formed in a body that performs various image processing operations.

The source driver 570 may include driving circuitry to drive data lines that are connected to pixels of the panel. For example, the source driver 570 may receive the image data that is processed by the image processing unit 550 and may drive the data lines to correspond to the received image data. According to an example embodiment, the source driver 570 may receive the image data in accordance with the frame rate and may drive the panel.

According to an example embodiment, in a normal mode (e.g., the electronic device is not in a low-power mode), the display driving circuit may store the image data that is received through the interface unit 510 in the graphic memory 533, process the image data that is stored in the graphic memory 533 to match the frame rate through the image processors 551 and 553, and transmit the processed image data to the source driver 570.

According to an example embodiment, if a moving image is received, the display driving circuit may store the image data that is received through the interface unit 510 in the graphic memory 533, process the image data that is stored in the graphic memory 533 to match the frame rate through the image processors 551 and 553, and transmit the processed image data to the source driver 570.

Figure 6:
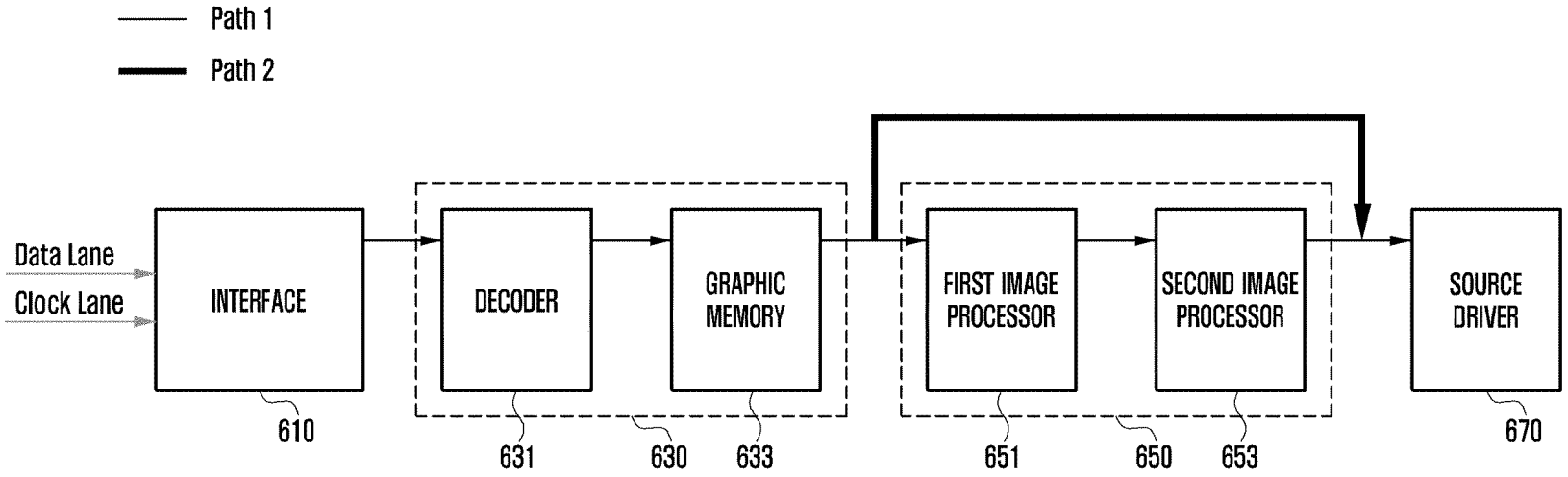
FIG. 6 is a diagram schematically illustrating example data flow during driving of a display according to various example embodiments of the present disclosure.

FIG. 6 is a diagram schematically illustrating example data flow during driving of a display according to various example embodiments of the present disclosure.

According to an example embodiment, the display driving circuit may include an interface (e.g., including interface circuitry) 610, a graphic memory unit (e.g., including graphic processing and memory circuitry) 630, an image processing unit (e.g., including image processing circuitry) 650, and a source driver 670.

The interface 610 may receive image data and/or a clock signal. The interface 610 may transmit the received image data to the graphic memory unit 630.

According to an example embodiment, the graphic memory unit 630 may include a decoder 631 and a graphic memory 633.

The decoder 631 may decompress the compressed image data. According to various example embodiments, the decoder 631 may decompress the compressed image data that is received by the interface 610. For example, the decoder 631 may decompress the compressed image data that is received by the interface 610, and may transmit the decompressed image data to the graphic memory 633. According to an example embodiment, the decoder 631 may be connected to a rear end of the graphic memory 633 to decompress the compressed image data that is stored in the graphic memory 633. For example, the decoder 631 may decompress the compressed image data that is stored in the graphic memory 633, and may transmit the decompressed image data to the image processing unit 650 or the source driver 670.

The graphic memory 633 may store image data therein. For example, the graphic memory 633 may perform buffering of the image data that is received through the interface 610 before transmitting the image data to the image processing unit 650 or the source driver 670. Under the control of the controller, the graphic memory 633 may transmit the stored image data to the image processing unit 650 or may directly transmit the image data to the source driver.

The image processing unit 650 may include at least one image processor. For example, the image processing unit 650 may include a first image processor 651 and a second image processor 653. The first image processor 651 and the second image processor 653 respectively process the image data to the quality of the image data. The image processing unit 650 may transmit the processed image data to the source driver 670.

The source driver 670 may drive data lines that are connected to pixels of the display. For example, the source driver 670 may drive the data lines to correspond to the received image data, and the panel may output an image that corresponds to the received image data.

According to an example embodiment, the display driving circuit may control an image data processing path based on a mode of the electronic device. For example, in the case where the electronic device is in a normal mode, the display driving circuit may process the image data through a first path path1. In the case where the electronic device is in a low-power mode, the display driving circuit may process the image data through a second path path2. For example, the low-power mode may be a mode in which at least a partial function of the display is limited to reduce the power that is consumed in the display. For example, the low-power mode may be a mode in which simple information is displayed on the display, and in the low-power mode, a high-quality image processing operation is not required. For example, the low-power mode may be an Always On Display (AOD) mode. The AOD mode may be a mode in which at least a partial region of the display is always activated to display specific information on the display of the electronic device without user's continuous operation. For example, in the AOD mode, the electronic device may display time information on a predetermined region of the display, and may display a black screen or turn off the screen on the remaining region of the display. For example, the low-power mode may be a mode in which the display is partially activated. For example, in the low-power mode, the electronic device (e.g., display driving circuit) may activate the operation of the display driving circuit with respect to a partially designated region of the whole region of the panel, and may inactivate (deactivate) at least a part of the operation of the display driving circuit with respect to a region excluding the designated region. For example, in the low-power mode, the electronic device (e.g., display driving circuit) may drive the scan lines and data lines that are connected to the pixels of the panel only with respect to the partially designated region.

In the low-power mode, the display driving circuit may directly transmit the image data that is stored in the graphic memory 633 to the source driver 670 through bypassing of the image processing unit. For example, in the case where the image processing unit 650 processes the image data, the quality of the image data may be improved, but power consumption may be increased as data throughput is increased to process the high-quality image data. In the low-power mode, the display driving circuit bypasses the image processing unit 650 in accordance with the second path path2, and thus can reduce the power consumption to process the image data.

Figure 7:
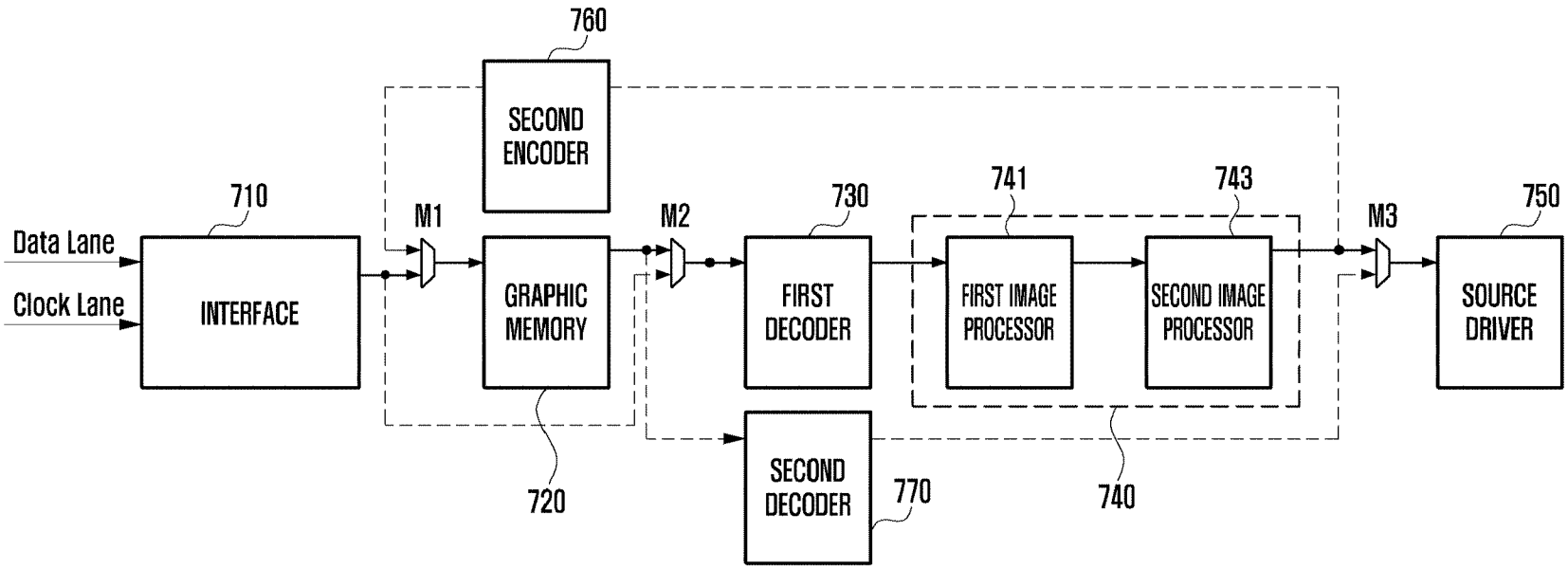
FIG. 7 is a diagram schematically illustrating example data flow during driving of a display according to various example embodiments of the present disclosure.

FIG. 7 is a diagram schematically illustrating example data flow during driving of a display according to various example embodiments of the present disclosure. FIG. 7 is a diagram illustrating an example image data processing path in the case where image data is moving image data according to an example embodiment of the present disclosure.

According to an example embodiment, the display driving circuit may include an interface (e.g., including interface circuitry) 710, a graphic memory 720, an encoder 760, at least one decoder, an image processing unit 740, and a source driver 750. According to an embodiment, the display driving circuit may include at least one multiplexer M1, M2, and M3 or at least one demultiplexer for controlling the image data path.

The interface 710 may receive image data or a clock signal from the electronic device (e.g., an element of the electronic device excluding the display driving circuit). The interface 710 may transmit the received image data to the graphic memory 720 or a first decoder 730.

The graphic memory 720 may store image data therein. For example, the graphic memory 720 may store therein image data that is received through the interface 710 or image data that is processed by the image processing unit 740 (including image data that is compressed by a second encoder 760). The graphic memory 720 may transmit the stored image data to the first or second decoder 730 or 770. For example, the graphic memory 720 may transmit the stored image data to the image processing unit 740 or the source driver 750.

The second encoder 760 may compress the image data that is processed by the image processing unit 740. The second encoder 760 may transmit the compressed image data to the graphic memory 720.

The first decoder 730 may decompress the image data that is stored in the graphic memory 720. For example, if the image data that is received through the interface 710 is compressed data, the first decoder 730 may be a decoder that corresponds to a compression format of the received image data. For example, the first decoder 730 may decompress the received image data to transmit the decompressed image data to the image processing unit 740.

The second decoder 770 may decompress the image data that is stored in the graphic memory 720. For example, the second decoder 770 may be a decoder that corresponds to the second encoder 760. For example, the second decoder 770 may decompress the image data that is compressed by the second encoder 760 to transmit the decompressed image data to the source driver 750.

The image processing unit 740 may include at least one image processor. For example, the image processing unit 740 may include a first image processor 741 and a second image processor 743. The first image processor 741 and the second image processor 743 may improve the quality of the image data through processing of the image data. The image processing unit 740 may transmit the processed image data to the source driver 750.

The source driver 750 may drive the data lines to correspond to the received image data, and the panel may output an image that corresponds to the received image data.

According to an example embodiment, if the received image data is moving image data, the display driving circuit may process the image data through the interface 710, the graphic memory 720, the first decoder 730, the image processing unit 740, and the source driver 750. For example, in the case of receiving the moving image data, the display driving circuit may inactivate the operations of the second encoder 760 and the second decoder 770. The display driving circuit may receive the moving image data in accordance with the frame rate, store the received moving image data, process the stored moving image data, and transmit the processed moving image data to the source driver 750.

Figure 8:
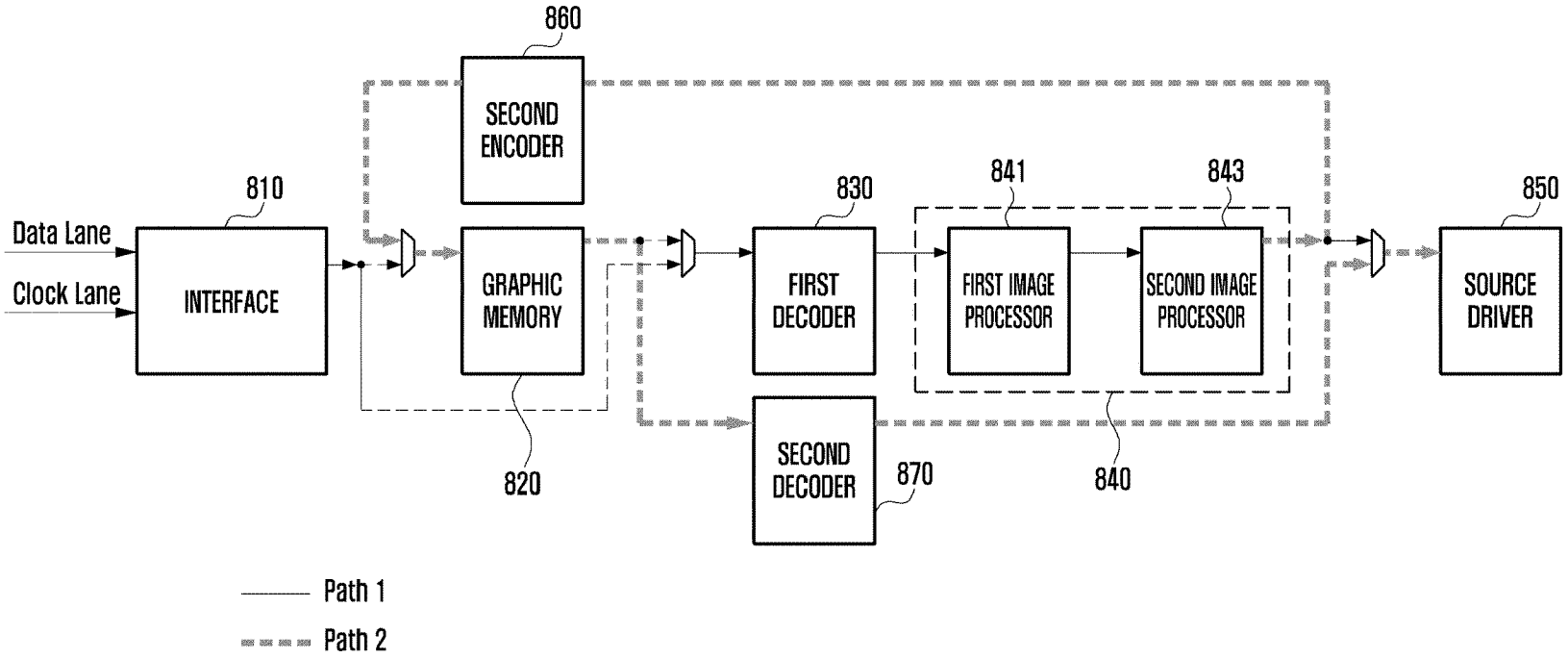
FIG. 8 is a diagram schematically illustrating example data flow during driving of a display according to various example embodiments of the present disclosure.

FIG. 8 is a diagram schematically illustrating example data flow during driving of a display according to various example embodiments of the present disclosure. FIG. 8 is a diagram illustrating an example image data processing path in the case where image data is still image data according to an example embodiment of the present disclosure.

An interface 810 may receive image data or a clock signal from the electronic device (e.g., an element of the electronic device excluding the display driving circuit). According to an example embodiment, the interface 810 may receive still image data. The interface 810 may receive the still image data at a speed that is equal to or lower than the frame rate. For example, in the case of displaying a still image on the display, the electronic device may periodically output the same still image to the panel in accordance with the frame rate. For example, in the case of displaying the still image, the electronic device may operate in a Panel Self Refresh (PSR) mode. For example, in the case of displaying the still image, the electronic device may output an image to the display without any additional signal or data through a processor of the electronic device using image data that is stored in a graphic memory 820 of the display driving circuit. The electronic device may reduce a power that is consumed when the electronic device processes the image data through a PSR function.

According to an example embodiment, if a still image is received, the display driving circuit may control an image data processing path in accordance with the processing cycle of the received still image. For example, the processing cycle may be a period in which a driving signal is applied to the panel to display the still image. For example, the processing cycle may be a period in which frames (e.g., still image) are displayed in accordance with the frame rate.

In the case of receiving the still image data through the interface 810, the display driving circuit may process the image data through a first path path1 in a first processing cycle. For example, the interface 810 may directly transmit the still image data that is received through bypassing of the graphic memory 820 in the first processing cycle to a first decoder 830. According to an example embodiment, if the received image data is not compressed data, the interface 810 may directly transmit the image data that is received through bypassing of the graphic memory 820 in the first processing cycle to an image processing unit 840.

The first decoder 830 may decompress the compressed image data. For example, the interface 810 may receive the compressed image data. If the image data that is received through the interface 810 is compressed data, the first decoder 830 may decompress the received image data. The first decoder 830 may decompress the still image data that is received from the interface 810 in the first processing cycle to transmit the decompressed still image data to the image processing unit 840.

The image processing unit 840 may process the image data that is received from the first decoder 830. The image processing unit 840 may include at least one image processor. For example, at least one image processor (e.g., a first image processor 841 and a second image processor 843) may successively process the image data to improve the quality of the image data. The image processing unit 840 may process the still image data that is received from the first decoder 830 in the first processing cycle to transmit the processed still image data to the source driver 850. According to an example embodiment, the image processing unit 840 may transmit the image data that is processed in the first processing cycle to the graphic memory 820.

According to an example embodiment, the image processing unit 840 may transmit the image data that is processed in the first processing cycle to a second encoder 860. The second encoder 860 may compress the image data that is processed by the image processing unit 840 to transmit the compressed image data to the graphic memory 820.

The graphic memory 820 may store therein the image data that is processed by the image processing unit 840 in the first processing cycle (including the image data that is compressed by the second encoder 860).

The source driver 850 may drive data lines that are connected to the panel. For example, the source driver 850 may drive the data lines to correspond to the image data that is processed by the image processing unit 840 in the first processing cycle.

If still image data is received, the display driving circuit may process the image data in accordance with a second path path2 in a second processing cycle.

If new still image data is not received through the interface 810 after the first processing cycle, the second processing cycle may proceed.

The graphic memory 820 may directly transfer the image data to the source driver 850 through bypassing of the image processing unit 840 in the second processing cycle. For example, the graphic memory 820 may directly transfer the image data that is processed by the image processing unit 840 in the first processing cycle to the source driver 850 in the second processing cycle.

According to an example embodiment, in the case where the image data that is processed by the image processing unit 840 is compressed by the second encoder 860 and stored in the graphic memory 820, the graphic memory 820 may transmit the image data to a second decoder 870 through bypassing of the image processing unit 840 in the second processing cycle. The second decoder 870 may decompress the image data that is compressed by the second encoder 860 to transmit the decompressed image data to the source driver 850.

For example, since the graphic memory 820 stores therein the image data that is processed by the image processing unit 840 in the first processing cycle, the image data may not be transmitted again to the image processing unit 840 in the second processing cycle. For example, the display driving circuit may omit in accordance with unnecessary image processing through bypassing of the image processing unit 840 according to the second path path2 in the second processing cycle, and may reduce power consumption in accordance with the image data processing.

According to an example embodiment, if new still image data is received through the interface 810, the display driving circuit may perform the operation of the first processing cycle. For example, the display driving circuit may repeat the operation of the second processing cycle until it receives new still image data. If new still image is received, the display driving circuit may process the image data along the first path path1 in the initial processing cycle of the still image, and may process the image data along the second path path2 in each processing cycle until a new still image is received after the initial processing cycle.

Figure 9:
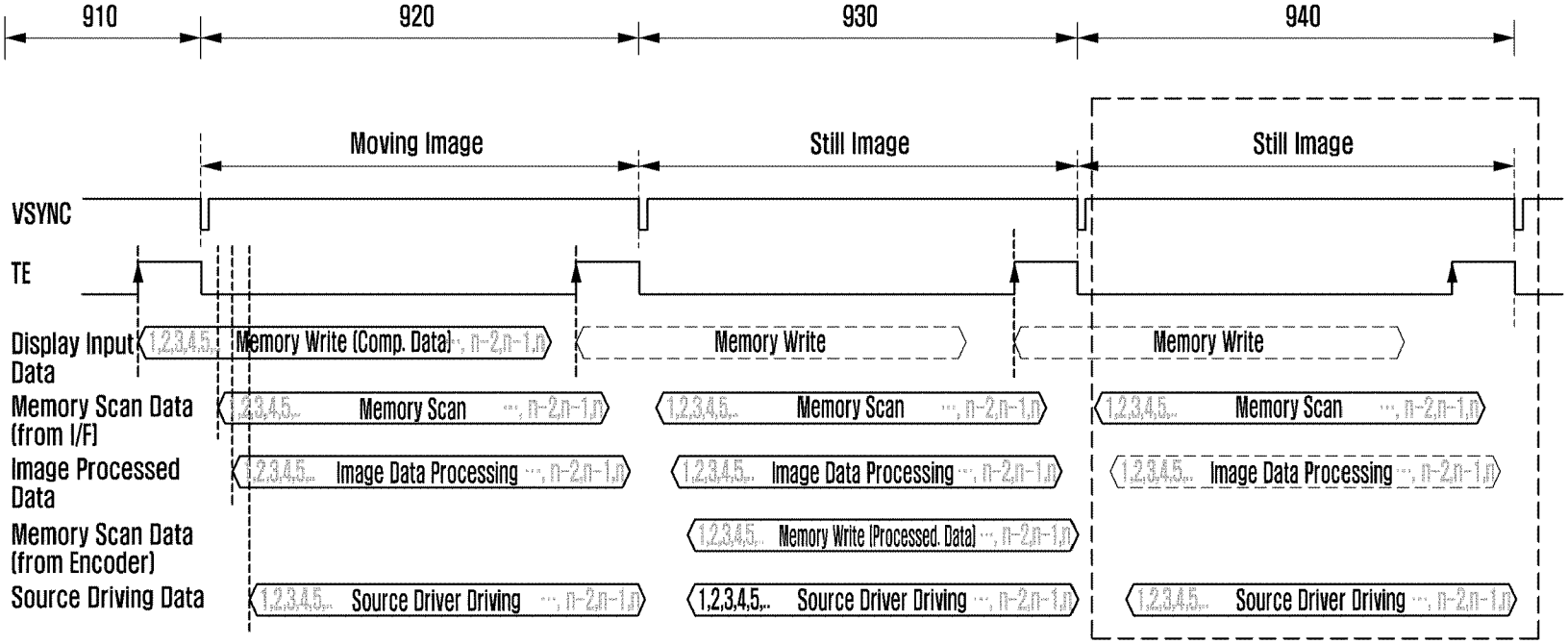
FIG. 9 is a timing diagram illustrating an example of driving of a display according to various example embodiments of the present disclosure.

FIG. 9 is a timing diagram illustrating an example of driving of a display according to various example embodiments of the present disclosure.

In section 910, the display driving circuit may transmit a signal for synchronization with the processor of the electronic device to the processor. For example, the display driving circuit may periodically transmit a Tearing Effect (TE) signal to the processor. The TE signal may be a signal for enabling the processor to transmit the image data in synchronization with the image data processing in the display driving circuit. For example, the processor of the electronic device may transmit the image data to the display driving circuit in response to the TE signal. For example, the processor may transmit the image data that is received from an outside of the electronic device or the image data that is stored in the memory of the electronic device to the display driving circuit.

According to an example embodiment, the processor may transmit the compressed image data to the display driving circuit. For example, the section 910 illustrates a case where the display driving circuit receives moving image data. If moving image data is received, the display driving circuit starts to store the received moving image data in the graphic memory. For example, the display driving circuit may periodically receive new image data in a moving image output section, and may store the received image data in the graphic memory.

Section 920 illustrates a case where the display driving circuit processes moving image data in accordance with a synchronization signal. The synchronization signal may be a signal for synchronizing the processing cycle in which the display driving circuit processes the image data. For example, the synchronization signal may be a vertical synchronization signal vsync.

The display driving circuit may scan the moving image data that is stored in the graphic memory in response to the synchronization signal. The display driving circuit may process the scanned moving image data. For example, the display driving circuit may process the image data through at least one image processor to improve the quality of the image data. The display driving circuit may drive the source driver after processing the image data. For example, the source driver may drive data lines that are connected to the panel to correspond to the processed image data.

Section 930 illustrates a case where the display driving circuit processes still image data. The section 930 illustrates the first processing cycle (initial processing cycle) in which the display driving circuit processes the still image data. For example, the section 920 may be a section in which the previously received image data (moving image data that is received in the section 910) is output as a still image. For example, in the section 920, the display driving circuit may output the image data that was received in the previous cycle on the panel as the still image. For example, the display driving circuit may not receive new image data. According to an example embodiment, the display driving circuit may receive still image data that is different from the moving image data that was previously received through the interface. For example, if new still image data is received, the display driving circuit may immediately process the new still image data through the image processor without storing the same.

The display driving circuit may scan the image data that is stored in the graphic memory in response to the synchronization signal. For example, the display driving circuit may scan the image data that is stored in the graphic memory in the previous cycle. The display driving circuit may process the image data that is scanned through the image processor. For example, the display driving circuit may store the processed image data in the graphic memory. The display driving circuit may drive the source driver after processing the image data. For example, the source driver may drive data lines that are connected to the panel to correspond to the processed image data.

Section 940 illustrates a case where the display driving circuit processes the still image data to follow the section 930. The section 940 is a section in which the display driving circuit processes the still image that is the same as the still image in the section 930, and in the section 940, the display driving circuit may receive the same still image data again or may not record the still image data in the memory.

The display driving circuit may scan the graphic memory in response to the synchronization signal. For example, the display driving circuit may scan the image data that is processed and stored through the image processor in the previous processing cycle (section 930).

In this case, since the scanned image data has already been processed through the image processor, the display driving circuit may not process the image data again. For example, the display driving circuit may operate to directly transmit the image data that is scanned from the graphic memory. In section 940, the display driving circuit may immediately drive a source driver without processing the image data. For example, the source driver may driver the data lines connected to the panel to corresponding the image data that is directly received from the graphic memory. For example, in the section 940, the display driving circuit may reduce power consumption through minimization of an unnecessary operation.

According to various example embodiments of the present disclosure, in the case of processing a still image, the display driving circuit may reduce image data throughput through omission of repetitive image data processing, and may reduce the power consumption according to the repeated data operation.

According to various example embodiments of the present disclosure, the electronic device may include a display and a processor that is electrically connected to the display. According to an example embodiment, the display may include a panel and a display driving circuit. According to an example embodiment, the display IC may include an interface that receives image data, a graphic memory that stores the received image data, at least one image processor that processes the stored image data, a source driver that drives data lines connected to pixels of the panel, and a controller that controls a processing path of the image data under the control of the processor.

According to an example embodiment, the controller may operate to directly transmit the stored image data to the source driver through bypassing of the at least one image processor in a low-power mode.

According to an example embodiment, if the received image data is still image data, the controller may operate to directly transmit the received image data to the at least one image processor through bypassing of the graphic memory in a first processing cycle, and to store the image data that is processed by the at least one image processor in the graphic memory.

According to an example embodiment, the controller may operate to directly transmit the processed image data that is stored in the graphic memory to the source driver through bypassing of the at least one image processor in a second processing cycle.

According to an example embodiment, the display driving circuit may further include an encoder that compresses the image data that is stored in the graphic memory.

According to an example embodiment, the display driving circuit may further include at least one decoder that decompresses the received image data or the compressed image data that is stored in the graphic memory.

According to an example embodiment, in the low-power mode, the controller may activate the operation of the display driving circuit with respect to a partially designated region of the whole region of the panel, and may inactivate at least a part of the operation of the display driving circuit with respect to the region excluding the designated region.

According to an example embodiment, if the received image data is the same as the previously received image data, the controller may operate to directly transmit the received image data to the at least one image processor through bypassing of the graphic memory in the first processing cycle, and to store the image data that is processed by the at least one image processor in the graphic memory.

According to an example embodiment, the controller may operate to directly transmit the quality-improved image data that is stored in the graphic memory to the source driver through bypassing of the at least one image processor in the second processing cycle.

According to an example embodiment, if the image data is still image data, the interface may receive the image data at a speed that is equal to or lower than a set frame rate, whereas if the image data is moving image data, the interface may receive the image data at a speed that corresponds to the set frame rate.

According to an example embodiment, the controller may operate to transmit the image data that is processed by the at least one image processor or the image data that is stored in the graphic memory to the source driver in accordance with the set frame rate.

According to various example embodiments of the present disclosure, an electronic device may include a display; a processor configured to generate a plurality of frame images including a first frame image and a second frame image to be provided to the display; and a display driving circuit including an image processor and a memory, and configured to drive the display using the first frame image and the second frame image that are provided from the processor. The display driving circuit may confirm the second image frame in relation to the first image frame, display, through the display, a third image frame that is obtained through the image processor that processes the first image frame or the second image frame using an image processing scheme if the second image frame satisfies a first condition, and store the third image frame in the memory and display the stored third image frame through the display if the second image frame satisfies a second condition.

According to an example embodiment, the display driving circuit may be set to compare at least a part of the first image frame with at least a part of the second image frame, and if it is determined that the at least a part of the first image frame is not the same as the at least a part of the second image frame, the display driving circuit may be set to determine that the first condition is satisfied.

According to an example embodiment, the display driving circuit may be set to compare the first image frame with the second image frame, and if it is determined that the first image frame is not the same as the second image frame, the display driving circuit may set to determine that the first condition is satisfied.

According to an example embodiment, the display driving circuit may be set to determine that the second condition is satisfied if the first condition is not satisfied.

According to an example embodiment, the display driving circuit may be set to bypass the image processor if the second condition satisfied.

According to an example embodiment, the display driving circuit may be set so that the image processor does not provide the image frame to the display if the second condition is satisfied.

According to an example embodiment, processing using the above-described image processing may include image frame noise removal, contrast ratio control, color sense increase, picture quality improvement, or a combination thereof.

According to an example embodiment, the display driving circuit may be set to bypass the image processor if the electronic device is in a low-power mode.

According to an example embodiment, the electronic device may further include an encoder configured to compress the third image frame. The display driving circuit may be set to compress the third image frame using the encoder and then to store the compressed third image frame in the memory.

According to an example embodiment, the electronic device may further include a decoder configured to decompress the compressed third image frame and then to display the decompressed third image frame through the display.

Figure 10:
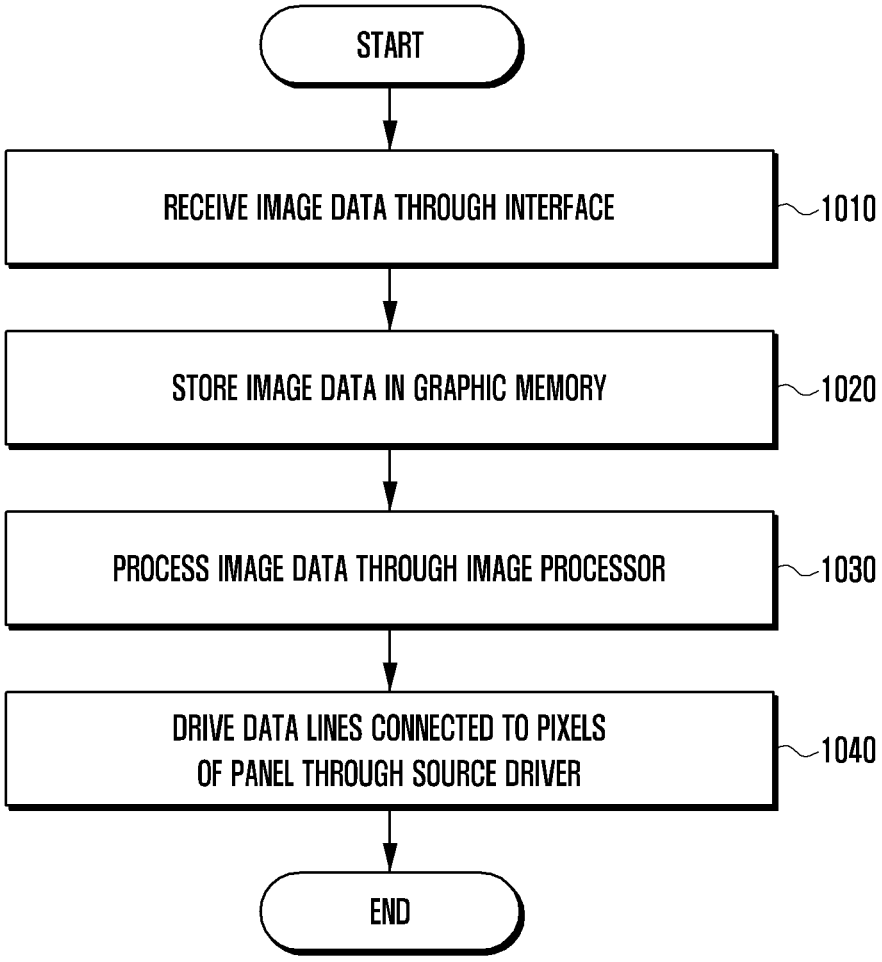
FIG. 10 is a flowchart illustrating an example method of driving a display according to various example embodiments of the present disclosure.

FIG. 10 is a flowchart illustrating an example method of driving a display according to various example embodiments of the present disclosure.

According to various example embodiments, an electronic device may include a display that is provided with a panel and a display driving circuit. According to an example embodiment, the display driving circuit may include an interface, a graphic memory, at least one image processor, a source driver, and a controller.

At operation 1010, the display driving circuit may receive image data through the interface. For example, the image data may include still image data and moving image data.

At operation 1020, the display driving circuit may store the image data in the graphic memory. For example, the display driving circuit may perform buffering of the image data that is received through the interface in the graphic memory.

At operation 1030, the display driving circuit may process the image data using at least one image processor. For example, the display driving circuit may improve the quality of the image data. For example, the display driving circuit may improve the picture quality, color sense, and contrast of the image data using a plurality of image processors, and may remove noise that is included in the image data.

At operation 1040, the display driving circuit may drive data lines that are connected to pixels of the panel through the source driver. For example, the source driver may drive the data lines to correspond to the image data that is processed by the image processor.

According to various example embodiments, the display driving circuit may repeatedly perform the above-described operations for each image data processing cycle.

Figure 11:
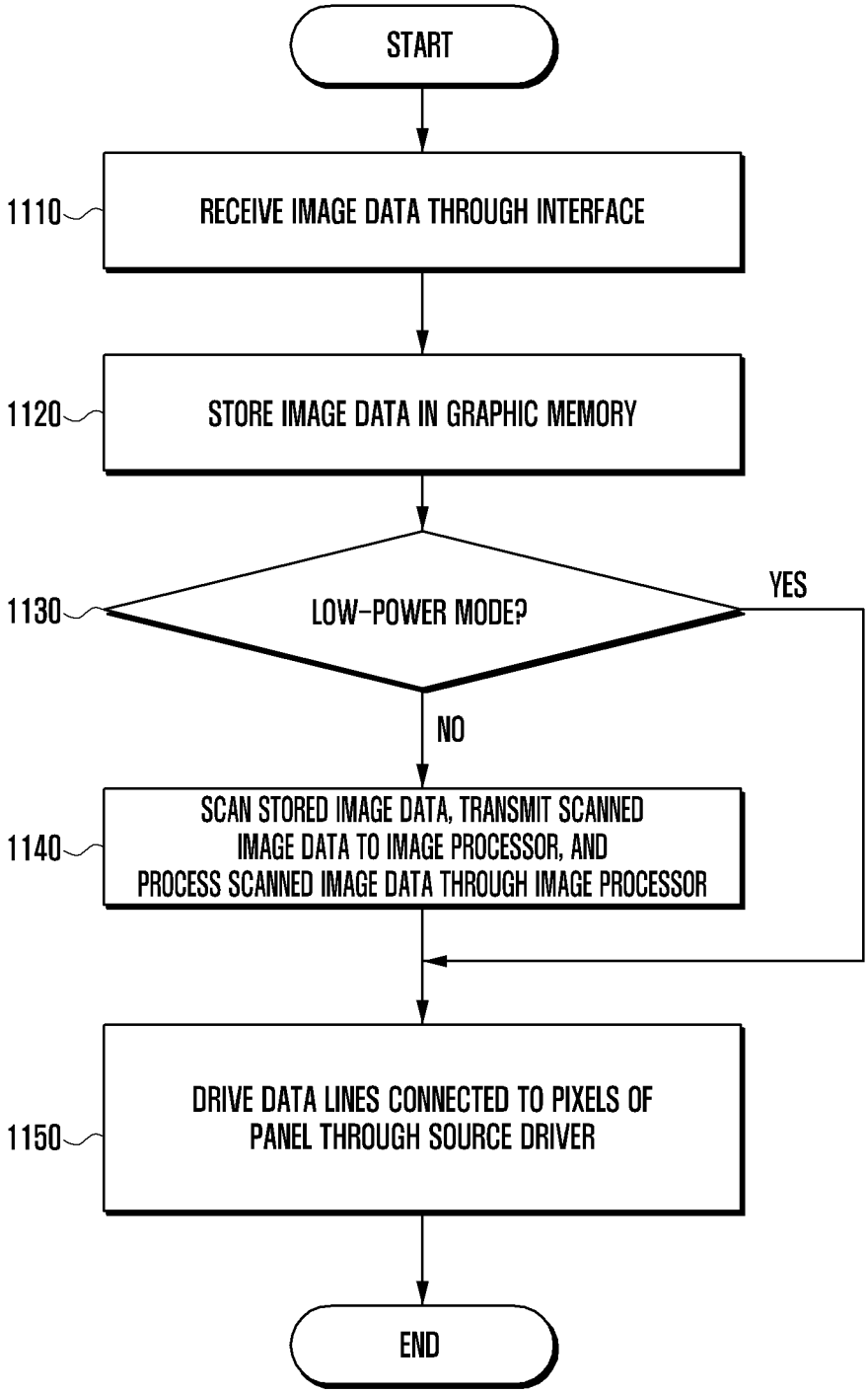
FIG. 11 is a flowchart illustrating an example method of driving a display according to various example embodiments of the present disclosure.

FIG. 11 is a flowchart illustrating an example method of driving a display according to various example embodiments of the present disclosure.

According to various example embodiments, an electronic device may include a display that is provided with a panel and a display driving circuit. According to an example embodiment, the display driving circuit may include an interface, a graphic memory, at least one image processor, a source driver, and a controller. According to various example embodiments of the present disclosure, the display driving circuit may control a path that processes image data under the control of the controller. For example, the display driving circuit may differently set the path that processes the image data in accordance with a mode of the electronic device.

At operation 1110, the display driving circuit may receive the image data through the interface.

At operation 1120, the display driving circuit may store the image data in the graphic memory. For example, the display driving circuit may perform buffering of the image data that is received through the interface in the graphic memory.

At operation 1130, the display driving circuit may determine whether the electronic device is in a low-power mode. For example, the low-power mode may refer, for example, to a state where the electronic device is performing an Always On Display (AOD) mode. The display driving circuit may control an image data processing path based on the mode of the electronic device. For example, the display driving circuit may transmit the image data that is stored in the graphic memory to an image processor if the electronic device is not in the low-power mode. If the electronic device is in the low-power mode, the display driving circuit may directly transmit the image data that is stored in the graphic memory to the source driver through bypassing of the image processor. If the electronic device is not in the low-power mode, the display driving circuit may perform operation 1150.

At operation 1140, the display driving circuit may scan the image data that is stored in the graphic memory and may transmit the scanned image data to the image processor. The image processor may improve the quality of the image data through processing of the image data.

At operation 1150, the display driving circuit may drive data lines that are connected to pixels of the panel through the source driver. For example, the source driver may drive the data lines to correspond to the image data that is received from the image processor or the image data that is directly received from the graphic memory. For example, the source driver may bypass the image processor in the low-power mode to directly receive the image data from the graphic memory. The source driver may receive the image data that is processed by the image processor if the current mode is not the low-power mode. The source driver may drive the data lines to correspond to the image data that is received for each image data processing cycle.

Figure 12:
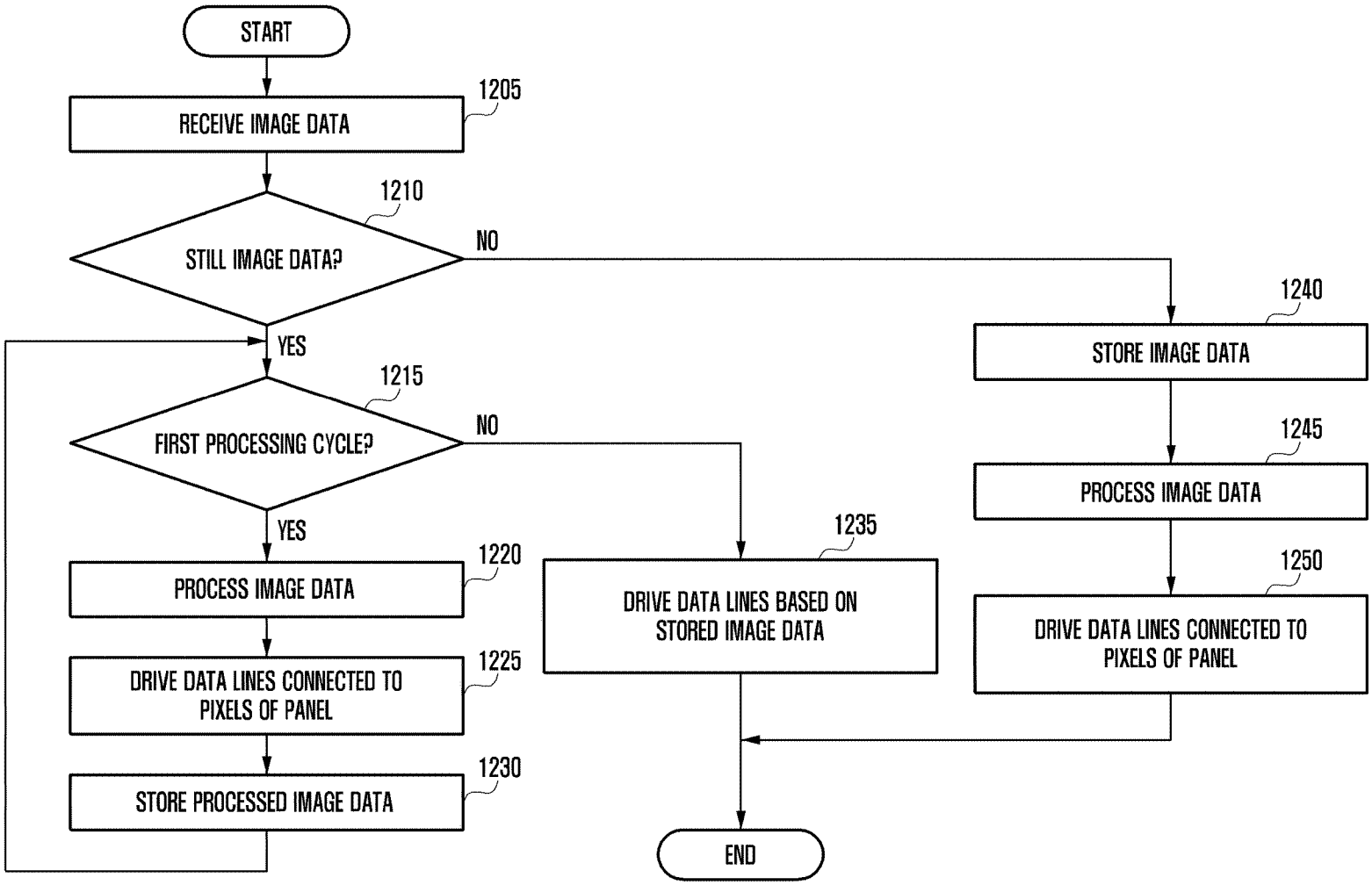
FIG. 12 is a flowchart illustrating an example method of driving a display according to various example embodiments of the present disclosure.

FIG. 12 is a flowchart illustrating an example method of driving a display according to various example embodiments of the present disclosure.

According to various example embodiments, an electronic device may include a display that is provided with a panel and a display driving circuit. According to an example embodiment, the display driving circuit may include an interface, a graphic memory, at least one image processor, a source driver, and a controller. According to various example embodiments of the present disclosure, the display driving circuit may control a path that processes image data under the control of the controller. For example, the display driving circuit may differently set the path that processes the image data depending on whether the image data is still image data or moving image data.

At operation 1205, the display driving circuit may receive the image data through the interface. According to an example embodiment, if the image data is the moving image data, the interface may receive the image data at a speed that corresponds to the frame rate. If the image data is the still image data, the interface may receive the image data at a speed that is equal to or lower than the frame rate.

At operation 1210, the display driving circuit may determine whether the received image data is still image data. For example, if the received image data is the still image data, the display driving circuit may perform operation 1215. If the received data is moving image data, the display driving circuit may perform operation 1240. According to an example embodiment, whether the received image data is the still image data or the moving image data may be determined depending on whether the electronic device displays a moving image or a still image on the display. For example, even in the case of the same image data, if the electronic device displays the moving image on the display, the received image data may be the moving image data, whereas if the electronic device displays the still image, the received image data may be the still image data. For example, in the case where the electronic device performs Panel Self Refresh (PSR) function, the display driving circuit may determine that the still image data has been received. According to an example embodiment, the display driving circuit may determine whether the received image is still image data on the basis of a signal that is received from the processor of the electronic device.

At operation 1215, the display driving circuit may determine whether a processing cycle is a first cycle after reception of the still image. For example, the display driving circuit may determine whether the processing cycle is the initial processing cycle for processing the still image. If the processing cycle is the first processing cycle of the still image, the display driving circuit may perform operation 1220. If the processing cycle is a second processing cycle (e.g., processing cycle after the initial processing cycle) of the still image, the display driving circuit may perform operation 1235.

At operation 1220, the display driving circuit may process the image data. For example, the display driving circuit may process the image data using at least one image processor to improve the quality of the image data. For example, the display driving circuit may directly transmit the image data that is received through the interface to the image processor through bypassing of the graphic memory in the first processing cycle.

At operation 1225, the display driving circuit may drive data lines that are connected to pixels of the panel. For example, the display driving circuit may transfer the image data that is processed by the image processor to the source driver. The source driver may drive the data lines that are connected to the pixels of the panel to correspond to the received image data.

At operation 1230, the display driving circuit may store the image data that is processed by the image processor in the graphic memory.

At operation 1235, the display driving circuit may drive the data lines based on the image data that is stored in the graphic memory. For example, in the second processing cycle, the graphic memory may store therein the image data processed by the image processor in the first processing cycle. The display driving circuit may scan the image data that has been preprocessed and stored in the graphic memory in the second processing cycle to transfer the scanned image data to the source driver. The source driver may drive the data lines connected to the pixels of the panel to correspond to the image data that is directly received from the graphic memory.

According to various example embodiments, if the received image data is the still image data, the display driving circuit may directly process the received image data through the image processor in the first processing cycle, and then may drive the source driver using the processed image data. The display driving circuit may drive the source driver without any separate image data processing using the preprocessed and stored image data in the second processing cycle. Since the display driving circuit processes the image data through the image processor only in the initial processing cycle of the still image data, unnecessary repeated processing of the image data can be prevented, and power consumption in accordance with the repeated image data processing can be reduced.

At operation 1240, the display driving circuit may store the moving image data in the graphic memory.

At operation 1245, the display driving circuit may process the image data that is stored in the graphic memory through the image processor. For example, the display driving circuit may transmit and process the image data that is stored in the graphic memory through the image processor, and thus the quality of the image data can be improved. According to an example embodiment, the image processing module may process the image data with the same frequency as the set frame rate.

At operation 1250, the display driving circuit may drive the data lines connected to the pixels of the panel. For example, the source driver may drive the data lines to correspond to the image data that is received from the image processor. According to an example embodiment, the source driver may drive the data lines in accordance with the set frame rate.

According to an example embodiment of the present disclosure, if the image data is the moving image data, the display driving circuit may repeat to store the image data that is received in all processing cycles, to process the stored image data, and to drive the data lines through transmission of the processed image data to the source driver.

Figure 13:
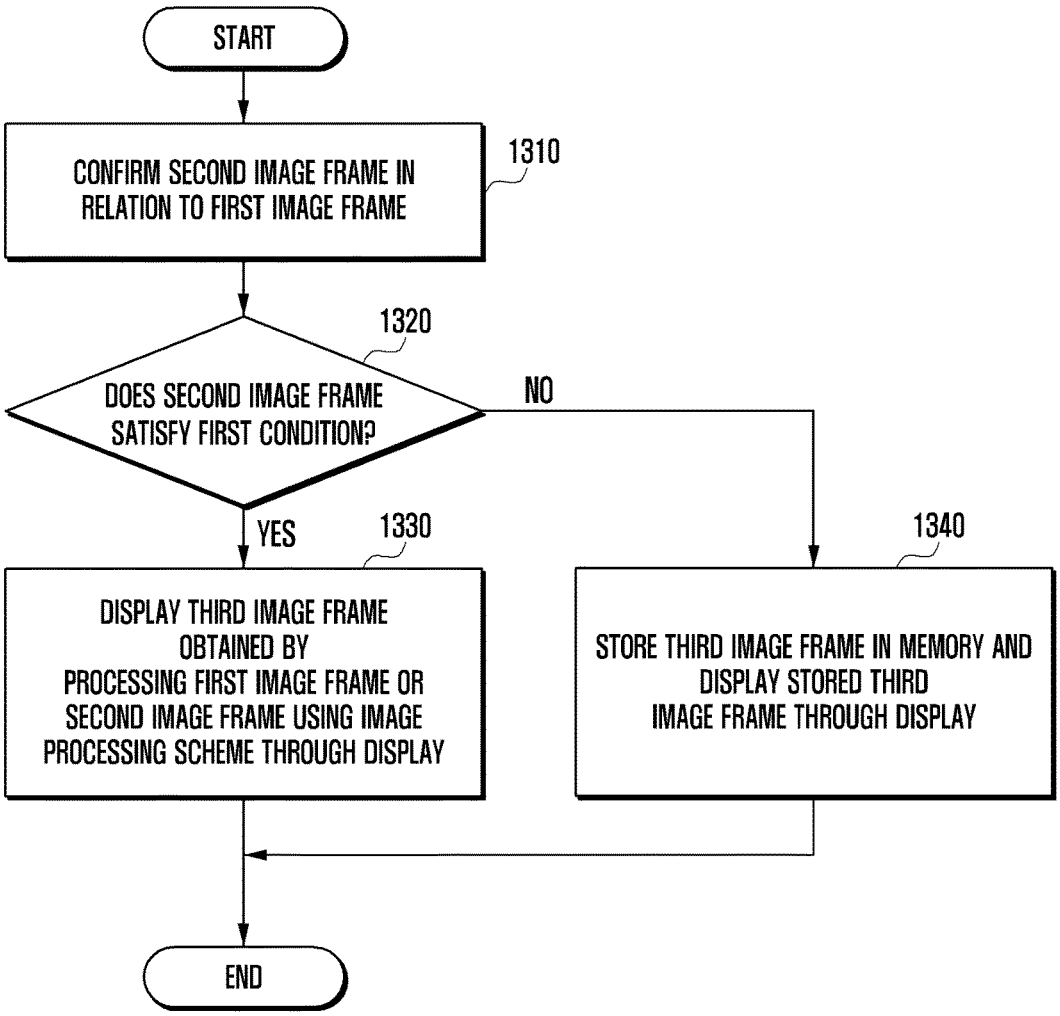
FIG. 13 is a flowchart illustrating an example method of driving a display according to various example embodiments of the present disclosure.

FIG. 13 is a flowchart illustrating an example method for driving a display of an electronic device according to various example embodiments of the present disclosure.

According to various example embodiments, an electronic device may include a display, a processor, and a display driving circuit. The processor may generate a plurality of frame images including a first frame image and a second frame image to be provided to a display. The display driving circuit may include an image processor and a memory. The display driving circuit may drive the display using the first frame image and the second frame image that are provided from the processor.

At operation 1310, the electronic device (e.g., display driving circuit) may confirm (e.g., compare) a second image frame in relation to a first image frame. For example, the display driving circuit may confirm the first image frame and the second image frame that are generated by the processor in relation to each other. For example, the first image frame and the second image frame may be image frames that the display driving circuit successively receives from the processor.

At operation 1320, the electronic device (e.g., display driving circuit) may determine whether the second image frame satisfies a first condition. For example, the first condition may be a condition that the first image frame is not the same as the second image frame. As another example, the first condition may be a condition that at least a part of the first image frame is not the same as at least a part of the second image frame. According to an example embodiment, the display driving circuit may compare the first image frame with the second image frame. The display driving circuit may determine whether the first image frame (or at least a part of the first image frame) is the same as the second image frame (or at least a part of the second image frame) through comparison of the first image frame and the second image frame with each other.

According to an example embodiment, the first condition may be a condition that the electronic device is not in a low-power mode. For example, the low-power mode may be a mode in which the electronic device is in an Always On Display (AOD) state.

If the second image frame satisfies the first condition, the display driving circuit may perform operation 1330. If the second image frame does not satisfy the first condition, the display driving circuit may perform operation 1340.

According to an example embodiment, if the second image frame does not satisfy the second condition, the display driving circuit may perform operation 1340. For example, the second condition may be a condition that does not satisfy the first condition. For example, if the first condition is not satisfied, the display driving circuit may determine that the second condition is satisfied. According to an example embodiment, the second condition may be a condition that the electronic device is in a low-power mode.

At operation 1330, the electronic device (e.g., display driving circuit) may display a third image frame that is obtained by processing the first image frame or the second image frame using an image processing scheme through the display. For example, the image processor that is included in the display driving circuit may generate the third image frame through processing of the first image frame or the second image frame using the image processing scheme. For example, the image processor may remove noise, control the contrast ratio, increase the color sense3, or improve the picture quality. The display driving circuit may display the third image frame that is generated by the image processor through the display.

At operation 1340, the electronic device (e.g., display driving circuit) may store a third image frame in a memory. For example, the display driving circuit may include an image processor and a memory. The display driving circuit may store the third image frame that is generated by the image processor in the memory of the display driving circuit. For example, the memory of the display driving circuit may be a graphic memory that is separately included in the display driving circuit. The electronic device (e.g., display driving circuit) may display the third image frame that is stored in the memory through the display.

According to an example embodiment, if the second image frame does not satisfy the first condition, the electronic device (e.g., display driving circuit) may control the image processor not to provide the image frame to the display. For example, if the second image frame does not satisfy the first condition, the display driving circuit may bypass the image processor, and may display the third image frame that is stored in the memory of the display driving circuit through the display. For example, if the first condition is not satisfied, the display driving circuit may omit the operation of processing the image frame that is provided from the processor through the image processor, and may display the image frame (third image frame) that is preprocessed and stored in the image processor, and may display the preprocessed and stored image frame (third image frame) through the display.

According to an example embodiment of the disclosure, a method for driving a display of an electronic device that includes a display including a panel and a display driving circuit including a display, a graphic memory, at least one image processor, and a source driver, includes receiving the image data through the interface, storing the image data in the graphic memory, causing the at least one image processor to process the stored image data, and causing the source driver to drive the data lines connected to the pixels of the panel.

According to an example embodiment, the method may directly transmit the stored image data to the source driver through bypassing of the at least one image processor in the low-power mode.

According to an example embodiment, the method may activate the operation of the display driving circuit with respect to a designated region of the whole region of the panel, and may inactivate (deactivate) at least a part of the operation of the display driving circuit with respect to the region excluding the designated region.

According to an example embodiment of the present disclosure, a method for driving a display of an electronic device that includes a display including a panel and a display driving circuit including a display, a graphic memory, at least one image processor, and a source driver, includes receiving the image data through the interface, storing the image data in the graphic memory, causing the at least one image processor to process and transmit the stored image data, and causing the source driver to drive the data lines connected to the pixels of the panel.

According to an example embodiment, the method may directly transmit the received data to the at least one image processor through bypassing of the graphic memory in a first processing cycle if the received image data is still image data.

According to an example embodiment, the method may further include storing the image data that is processed by the at least one image processor in the graphic memory in the first processing cycle.

According to an example embodiment, the method may directly transmit the image data that is processed in the first processing cycle stored in the graphic memory to the source driver through bypassing of the at least one image processing module in a second processing cycle.

According to an example embodiment, the method may further include compressing the received image data or the image data that is processed by the at least one image processor.

According to an example embodiment, the method may further include decompressing the received image data or compressed image data that is stored in the graphic memory.

According to an example embodiment, the receiving the image data may include receiving the image data at a speed that is equal to or lower than a set frame rate if the image data is still image data, and receiving the image data at a speed that corresponds to the set frame rate if the image data is moving image data.

According to an example embodiment, the driving the data lines may include transmitting the image data that is processed by the at least one image processing module or the image data that is stored in the graphic memory in accordance with the set frame rate.

According to various example embodiments of the present disclosure, a method for driving a display of an electronic device, including a display, a processor configured to generate a plurality of frame images including a first frame image and a second frame image to be provided to the display, and a display driving circuit including an image processor and a memory, includes comparing, by the display driving circuit, the second image frame to the first image frame; displaying, through the display, a third image frame obtained through the image processor that processes the first image frame or the second image frame using an image processing scheme if the second image frame satisfies a first condition; and storing the third image frame in the memory and displaying the stored third image frame through the display if the second image frame satisfies a second condition.

According to an example embodiment, the method may further include comparing at least a part of the first image frame with at least a part of the second image frame; and if it is determined that the at least a part of the first image frame is not the same as the at least a part of the second image frame, determining that the first condition is satisfied.

According to an example embodiment, the method may further include comparing the first image frame with the second image frame; and if it is determined that the first image frame is not the same as the second image frame, determining that the first condition is satisfied.

According to an example embodiment, the method may determine that the second condition is satisfied if the first condition is not satisfied.

According to an example embodiment, the method may bypass the image processor if the second condition satisfied.

According to an example embodiment, the method may further include controlling the image processor not to provide the image frame to the display if the second condition is satisfied.

According to an example embodiment, processing using the above-described image processing may include image frame noise removal, contrast ratio control, color sense increase, picture quality improvement, or a combination thereof.

According to an example embodiment, the method may bypass the image processing module if the electronic device is in a low-power mode.

According to an example embodiment, the method may further include compressing the third image frame using an encoder included in the electronic device, and then storing the compressed third image frame in the memory.

A term "module" used in the present disclosure may be a unit including a combination of at least one of, for example, hardware, software, or firmware, or any combination thereof. The term "module" may be interchangeably used with a term such as a unit, logic, a logical block, a component, or a circuit. The "module" may be a minimum unit or a portion of an integrally formed component. The "module" may be a minimum unit or a portion that performs at least one function. The "module" may be mechanically or electronically implemented. For example, a "module" according to an example embodiment of the present disclosure may include, without limitation, at least one of a dedicated processor, a CPU, an Application-Specific Integrated Circuit (ASIC) chip, Field-Programmable Gate Arrays (FPGAs), or a programmable-logic device that performs any operation known or to be developed.

According to various example embodiments, at least a portion of a method (e.g., operations) or a device (e.g., modules or functions thereof) according to the present disclosure may be implemented with an instruction stored at computer-readable storage media in a form of, for example, a programming module. When the instruction is executed by at least one processor (e.g., the processor 120), the at least one processor may perform a function corresponding to the instruction. The computer-readable storage media may be, for example, the memory 130. At least a portion of the programming module may be implemented (e.g., executed) by, for example, the processor 120. At least a portion of the programming module may include, for example, a module, a program, a routine, sets of instructions, or a process that performs at least one function.

The computer-readable storage media may include magnetic media such as a hard disk, floppy disk, and magnetic tape, optical media such as a Compact Disc Read Only memory (CD-ROM) and a Digital Versatile Disc (DVD), magneto-optical media such as a floptical disk, and a hardware device, formed to store and perform a program instruction (e.g., a programming module), such as a Read Only memory (ROM), a Random Access memory (RAM), a flash memory. Further, a program instruction may include a high-level language code that may be executed by a computer using an interpreter as well as a machine language code generated by a compiler. In order to perform operation of the present disclosure, the above-described hardware device may be formed to operate as at least one software module, and vice versa.

A module or a programming module according to the present disclosure may include at least one of the foregoing elements, may omit some elements, or may further include additional other elements. Operations performed by a module, a programming module, or another element according to the present disclosure may be executed with a sequential, parallel, repeated, or heuristic method. Further, some operations may be executed in different orders, may be omitted, or may add other operations.

According to various example embodiments, in a storage medium that stores instructions, when the instructions are executed by at least one processor, the instructions cause the at least one processor to perform at least one operation.

Although various example embodiments of the present disclosure have been described in detail hereinabove, it should be clearly understood that many variations and modifications of the present disclosure herein described, which may appear to those skilled in the art, will still fall within the spirit and scope of the example embodiments of the present disclosure as defined in the appended claims.

What is claimed is:

1. An electronic device comprising:

a display;

a processor configured to generate a plurality of encoded frame images, including a first encoded frame image, to be provided to the display; and a display driving circuit including an image-process circuit, a memory, and at least one decoder, the image-process circuit being downstream of the memory, the display driving circuit being configured to drive the display using the first encoded frame image provided from the processor, wherein the display driving circuit is further configured to:

receive the first encoded frame image, provided from the processor, and store the first encoded frame image in the memory;

generate a first decoded frame image by decoding the first encoded frame image after receiving and storing the first encoded frame image, generate a first image-processed frame image by image-processing the first decoded frame image after generating the first decoded frame image, cause to display, through the display, the first image-processed frame image as a first frame, generate a second encoded frame image by encoding the first image-processed frame image, and store the second encoded frame image in the memory, generate a second decoded frame image by decoding the second encoded frame image after storing the second encoded frame image, after generating the second decoded frame image, cause to display the second decoded frame image as a second frame through the display, without image-processing the second decoded frame image, while the processor is in a low-power state.

2. The electronic device of claim 1, wherein the display driving circuit is configured to:

compare at least a part of the first encoded frame image to at least a part of a third encoded frame image received from the processor, and determine that a first condition indicating that the electronic device is in a normal power state is satisfied if it is determined that the at least a part of the first encoded frame image is not the same as the at least a part of the third encoded frame image.

3. The electronic device of claim 2, wherein the display driving circuit is configured to determine that a second condition indicating that the electronic device is in the low power state is satisfied if the first condition is not satisfied.

4. The electronic device of claim 3, wherein the display driving circuit is configured to bypass the image-process circuit if the second condition is satisfied.

5. The electronic device of claim 2, wherein the display driving circuit is configured to control the image-process circuit to not provide an image-processed frame image directly to the display if the second condition is satisfied.

6. The electronic device of claim 1, wherein the display driving circuit is configured to:

compare the first encoded frame image to the a third encoded frame image received from the processor, and to determine that a first condition indicating that the electronic device is in a normal power state is satisfied if it is determined that the first encoded frame image is not the same as the third encoded frame image.

7. The electronic device of claim 1, wherein the image-process circuit is configured to process the first decoded frame image to provide at least one of: noise removal, contrast ratio control, color sense increase, and picture quality improvement.

8. The electronic device of claim 1, wherein the display driving circuit is configured to bypass the image-process circuit if the electronic device is in a low-power state.

9. A method for driving a display of an electronic device, including a display, a processor configured to generate a plurality of encoded frame images including a first encoded frame image to be provided to the display, and a display driving circuit including an image-process circuit, a memory, and at least one decoder, wherein the image-process circuit is downstream of the memory, the method comprising:

receiving the first encoded frame image, provided from the processor, and storing the first encoded frame image in the memory;

generating a first decoded frame image by decoding the first encoded frame image after receiving and storing the first encoded frame image;

generating a first image-processed frame image by image-processing the first decoded frame image after generating the first decoded frame image;

displaying, through the display, the first image-processed frame image as a first frame;

generating a second encoded frame image by encoding the first image-processed frame image, and storing the second encoded frame image in the memory, generating a second decoded frame image by decoding the second encoded frame image after storing the second encoded frame image, after generating the second decoded frame image, displaying the second decoded frame image as a second frame through the display, without image-processing the second decoded frame image, while the processor is in a low-power state.

10. The method of claim 9, further comprising:

comparing at least a part of the first encoded frame image to at least a part of the a third encoded frame image receive from the processor; and determining that a first condition indicating that the electronic device is in a normal power state is satisfied if it is determined that the at least a part of the first encoded frame image is not the same as the at least a part of the third encoded frame image.

11. The method of claim 10, further comprising determining that a second condition indicating that the electronic device is in the low power state is satisfied if the first condition is not satisfied.

12. The method of claim 11, further comprising bypassing the image-process circuit if the second condition satisfied.

13. The method of claim 10, further comprising controlling the image-process circuit to not provide an image-processed frame image directly to the display if the second condition is satisfied.

14. The method of claim 9, further comprising:

comparing the first encoded frame image to the third encoded frame image; and determining that a first condition indicating that the electronic device is in a normal power state is satisfied if it is determined that the first encoded frame image is not the same as the third encoded frame image.

15. The method of claim 9, wherein image-processing by the image-process circuit comprises at least one of: frame image noise removal, contrast ratio control, color sense increase, and picture quality improvement.

16. The method of claim 9, further comprising bypassing the image-process circuit if the electronic device is in a low-power state.

17. A non-transitory computer readable recording medium storing therein one or more programs including instructions, which when executed by a processor, cause an electronic device, including a display, a processor configured to generate a plurality of encoded frame images including a first encoded frame image to be provided to the display, and a display driving circuit including an image-process circuit, a memory and at least one decoder, wherein the image-process circuit is downstream of the memory, to perform operations comprising:

receiving the first encoded frame image, provided from the processor, and storing the first encoded frame image in the memory;

generating a first decoded frame image by decoding the first encoded frame image after receiving and storing the first encoded frame image;

generating a first image-processed frame image by image-processing the first decoded frame image after generating a first decoded frame image;

displaying, through the display, the first image-processed frame image as a first frame;

generating a second encoded frame image by encoding the first image-processed frame image, and storing the second encoded frame image in the memory, generating a second decoded frame image by decoding the second encoded frame image after storing the second encoded frame image, after generating the second decoded frame image, displaying the second decoded frame image as a second frame through the display, without image-processing the second decoded frame image, while the processor is in a low-power state.

* * * * *